United States Patent [19]

Matsui et al.

[11] 3,968,307

[45] July 6, 1976

[54] MIXED FILAMENTS

[75] Inventors: Masao Matsui, Takatsuki; Susumu Tokura, Osaka; Masahiro Yamabe, Neyagawa, all of Japan

[73] Assignee: Kanegafuchi Boseki Kabushiki Kaisha, Japan

[22] Filed: June 4, 1973

[21] Appl. No.: 366,516

Related U.S. Application Data

[60] Division of Ser. No. 200,423, Nov. 19, 1971, which is a continuation of Ser. No. 801,277, Feb. 24, 1969, abandoned.

[30] Foreign Application Priority Data

| | | |
|---|---|---|
| Oct. 8, 1968 | Japan | 43-73319 |
| Feb. 29, 1968 | Japan | 43-13051 |
| July 30, 1968 | Japan | 43-53879 |
| July 30, 1968 | Japan | 43-53880 |

[52] U.S. Cl. ..... 428/373; 264/171; 264/DIG. 26; 428/374

[51] Int. Cl.[2] ..... D01D 5/28

[58] Field of Search .... 264/171, 168, 174, DIG. 26; 428/370, 373, 374

[56] References Cited

UNITED STATES PATENTS

| | | | |
|---|---|---|---|
| 3,531,368 | 9/1970 | Okamoto et al. | 264/171 |
| 3,562,374 | 2/1971 | Okamoto et al. | 264/174 |
| 3,577,308 | 5/1971 | Drunen et al. | 264/171 |
| 3,641,232 | 2/1972 | Fontijin et al. | 264/174 |
| 3,672,802 | 6/1972 | Matsui et al. | 264/171 |
| 3,681,189 | 8/1972 | Matsui et al. | 264/177 |
| 3,684,647 | 8/1972 | Matsui et al. | 264/177 F |
| 3,700,545 | 10/1972 | Matsui et al. | 264/171 |
| 3,701,619 | 10/1972 | Appeldoora et al. | 264/177 F |
| 3,706,613 | 12/1972 | Toki et al. | 264/171 |

OTHER PUBLICATIONS

Ross: "ISG Mixer" Bulletin

*Primary Examiner*—Jay H. Woo
*Attorney, Agent, or Firm*—Stevens, Davis, Miller & Mosher

[57] ABSTRACT

Multi-component mixed filament, wherein at least two spinning materials having poor affinity are mixed and dispersed in unitary filament in a nebular configuration containing at least 50 stars at least in one portion of the cross-section of the filament and the nebular configuration continues substantially in the longitudinal direction of the filament is manufactured by subjecting said spinning materials to at least eight times of "joining and dividing step in different phase" repeatedly to layer-multiply said spinning materials so as to form a nebular configuration in the cross-section of the resulting filament and then extruding the resulting mixture from orifice in a spinneret. In this manufacture, the preferable combinations of said two spinning materials having poor affinity are polyamide-polyester, polyamide-polyalkylne oxide, polyester-polyalkylene oxide and polyamide-polyolefin.

8 Claims, 31 Drawing Figures

MIXED FILAMENTS

This is a division of application Ser. No. 200,423, filed Nov. 19, 1971, which is a continuation of Ser. No. 801,277, filed Feb. 24, 1969, and now abandoned.

The present invention relates to a multicomponent mixed filament composed of at least two components, and a method for spinning said filaments.

A large number of mixed filaments composed of at least two components have been proposed in the past. The composite filament is one of mixed filaments. FIG. 1 shows a cross-sectional configuration of a side-by-side type composite filament and FIG. 2 shows that of a sheath-core type composite filament. In these composite filaments, spinning materials are mixed macroscopically. Furthermore, mixed filaments having a finely mixed configuration, for example, mixed filaments composed of more than 10 portions in the cross-section of unitary filament have been known. The present invention relates to mixed filaments having a finely mixed configuration.

In one of the finely mixed filaments, one component is dispersed in the other component in a fine granule- or needle-like state. For example, filaments having a needle-like mixed configuration are disclosed in Belgian Pat. No. 661,784 and in U.S. Pat. No. 3,382,305. Such filaments having a granule- or needle-like mixed configuration are satisfactory in view of the fineness of mixture, but have many drawbacks. That is, filaments having a granule- or needle-like mixed configuration have essentially discontinuous structure along the longitudinal direction of the unitary filament, and consequently the filaments are poor, for example, in the tensile strength, recovery for elongation, resistance for repeated elongations and bending, and fatigue resistance. The above-mentioned Belgian Patent discloses an improved mixed filament in which polyester is dispersed in polyamide in a form of microfiber, the diameter and the length of which are 1 ∞ and at most about 100 $\mu$, respectively, and it is impossible to say that the filament has a continuous structure.

In another finely mixed filament, composite filaments are further conjugated and such a mixed filament can be said to be a multiple composite filament. This multiple composite filament is disclosed, for example, in U.S. Pat. Nos. 2,932,079 and 3,382,534, and French Pat. No. 1,513,531. FIG. 3 is a cross-sectional view of a filament obtained by multiplying a side-by-side relation composite filament, and FIG. 4 is that of a filament obtained by multiplying a sheath-core relation composite filament. However, a very complicated spinning apparatus is necessary for the production of such multiple composite filaments and it is difficult to make the apparatus into a small size, and therefore the production of such multiple composite filaments is difficult. Furthermore, when a multiple side-by-side relation composite filament as shown in FIG. 3 is produced from components having no mutual affinity and adhesivity, separation between components is liable to be caused. The separation between components causes fibrillation or cracks in the unitary filament, for example, in the drawing step and winding step, and consequently yarn breakage occurs. While, in the multi-core composite filament as shown in FIG. 4, fibrillation hardly occurs, the surface of the filament is occupied by one component, so that improvements in touch, antistatic property for friction, dyeability and gloss cannot be attained.

Filaments as shown in FIGS. 3 and 4 (having a continuous structure along the longitudinal direction) can be said to be multi-layer filaments, because, these filaments are composed of a plurality of continuous layers extending along the longitudinal direction of the unitary filament. Other types multi-layer filaments have cross-sectional views as shown in FIGS. 5 – 7. FIG. 5 is a cross-sectional view of four-layer filament. Filaments shown in FIGS. 1 and 2 can be said to be two-layer filaments.

A filament having a grainy configuration in the cross-section (hereinafter described as grainy multi-layer filament) as shown in FIG. 6 has been disclosed in French Pat. No. 1,495,835, and such a filament has a structure in which the configuration as shown in FIG. 5 is multiplied. The grainy multi-layer filament as shown in FIG. 6 is satisfactory in view of the fineness of mixture, but when the components have no compatibility nor adhesivity, separation between the components occurs. In order to prevent fibrillation due to separation between the components, there has been proposed a sheath and core filament having a multi-layer configuration in the core, in which the core having a grain-like structure is surrounded by a sheath. However, a thick sheath is necessary for preventing fibrillation completely, and it is ipossible to fully attain the object of mixed filament.

The object of the present invention is to improve the above-mentioned drawbacks in the conventional mixed filaments and in the method of production thereof.

The first object of the present invention is to provide a novel filament, in which components having poor mutual affinity and adhesivity are mixed and fibrillation due to separation between the components scarcely occurs.

The second object of the invention is to provide a novel filament having a configuration mixed finely and substantially continuously along the longitudinal direction of the filament.

The third object of the present invention is to provide a filament having a novel mixed configuration, in which every component can occupy a part of the surface of the filament.

Other objects of the invention will be apparent from a study of the following description.

The inventors have made various investigations and experiments in order to improve multi-layer filaments and method for production thereof.

A very complicated apparatus has hitherto been used for the production of multi-layer filaments. However, the inventors have already proposed a spinning apparatus having a simple construction, which can be made compactly and be easily manufactured and maintained and further can produce uniform mixed filaments (multi-layer filaments) efficiently. That is, the inventors have proposed a spinning apparatus provided with a three dimensinal mixer (layer-multiplying mixer) composed of reservoirs and narrow passages connecting the reservoirs in the U.S. Pat. application Ser. No. 711,070 now U.S. Pat. No. 3,672,802 and Dutch patent application No. 68-03,669. Furthermore, the inventors have proposed a spinning apparatus having a layer-multiplying mixer which consists of three-dimensional passage network formed by only narrow passages in the U.S. Pat. application No. 783,508 now U.S. Pat. No. 3,613,802.

The above-mentioned spinning apparatus and spinning method proposed by the inventors are based on such idea that different kinds of spinning materials are joined and divided at many stages thus forming the spinning materials into a multi-layer filament.

For a better understanding of the invention reference is taken to the accompanying drawings, wherein FIGS. 1 and 2 are cross-sectional views of conventional two-component composite filaments, FIG. 3 is a cross-sectional view of a conventional multi-layer filament, FIG. 4 is a cross-sectional view of a conventional multi-core filament, FIG. 5 is a cross-sectional view of a conventional four-layer filament, FIGS. 6 and 7 are cross-sectional views of conventional filaments having a grainy multi-layer configuration, FIG. 8 is a cross-sectional view of a conventional filament having an archipelagic multi-layer configuration, FIGS. 9 – 14 are cross-sectional views of filaments having a nebular configuration in at least one part of the cross-section according to the invention, FIG. 15 is a view illustrating a basic method of stratifying two spinning materials into multi-layers, FIG. 16 is a similar view to FIG. 15 illustrating a method of stratifying three spinning materials into multi-layers, FIG. 17 is a model diagram showing a method of conjugate spinning a flow of layer-multiplied spinning materials and a flow of another spinning material, FIG. 18 is a model diagram showing a method of conjugate spinning a flow of layer-multiplied spinning materials and a flow of another layer-multiplied spinning materials, FIG. 19 is a vertical sectional view of a spinneret for carrying out the method of the invention, FIGS. 20, 21 and 22 are cross-sectional views of the spinneret shown in FIG. 19 taken on lines 1–1′, 2–2′ and 3–3′ respectively in the arrow direction, FIG. 23 is a vertical sectional view of a spinneret to be used for carrying out the method shown in FIG. 17, FIG. 24 is a cross-sectional view of the spinneret shown in FIG. 23 taken on line 4–4′ in the arrow direction, FIG. 25 shows a photomicrograph of cross-sections of a filament having an archipelagic cross-sectional configuration, FIGS. 26 – 31 are photomicrographs of cross-sections of filaments having a nebular cross-sectional configuration respectively, that is, FIGS. 26 and 27 are photomicrographs at the cross-section of polyethylene terephthalate/nylon-6 mixed filaments, FIG. 28 is that of modified polyethylene terephthalate/nylon-6 mixed filament, FIG. 29 is that of polyethylene oxide/nylon-6 mixed filament, FIG. 30 is that of polyethylene oxide/-polyethylene terephthalate mixed filament and FIG. 31 is that of polyethylene/nylon-6 mixed filament.

FIG. 15 is a view illustrating a basic method of stratifying two spinning materials into multi-layers.

Referring to FIG. 15, flows of two spinning materials A and B are joined at a point $J_1$ to form a two-layer structure, which is divided at a point S in a phase different from that of joining while remaining the joined state at least partly, preferably completely and then again joined at a point $J_2$ so as to sum at least partly, preferably completely the joined state. Thus, the flow of spinning materials obtained by two time joinings is composed of four layers A, B, A and B.

If such joining and dividing are repeated by $n$ stages, the number of the obtained layers may be calculated as $2^n$, when the joining and the dividing are carried out in completely different phase.

Figure 15:
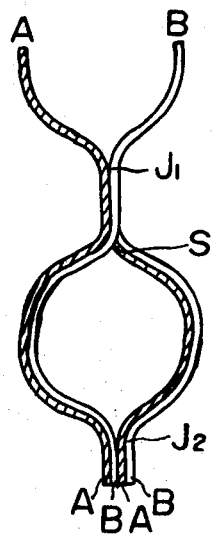
Figure 16:
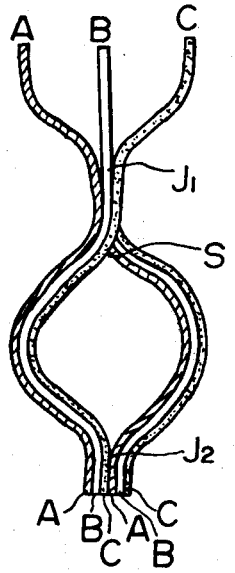

Of course, the above-mentioned number of layers is a calculated value. In practice, the number of layers may increase owing to irregularity of the flow of the spinning materials in the reservoirs and channels in the spinneret or decrease owing to the cohesion of the separated layers. FIG. 15 shows a basic type of stratifying the spinning materials into multi-layers, and there are numerous modifications and applications thereof, for example, a combination of at least two basic types. FIG. 16 shows an embodiment of such modification, in which three components are joined at $J_1$ in the first stage, and the number of layers obtained in this case is calculated to be $3 \times 2^{n-1}$. Moreover, the joining may be carried out in a sheath-core relation or in a side-by-side relation.

The above-mentioned joining and dividing are characterized by the relation of their directions (phase). The joining and dividing should be carried out in different directions, most preferably, in directions different by 90°. Such joining and dividing are called as "joining and dividing in different phase." One important method of producing multi-layer filaments consist of joining and dividing a plurality of spinning materials at a number of stages repeatedly in different phase to layer-multiply the spinning materials and to spin the layer-multiplied spinning materials.

The inventors have found that the shape of layers in the cross-section of the filament obtained by such a layer-multiplying process considerably varies depending upon the viscosity and surface tension and mutual affinity of spinning materials.

Figure 5:
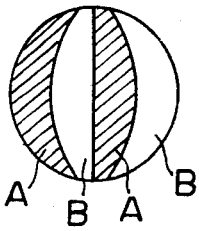
FIG. 5 is an embodiment of cross-section of a filament obtained by joining two spinning materials A and B at two stages.
Figure 6:
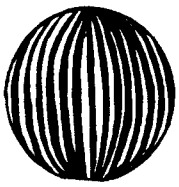
FIGS. 6 and 7 are embodiments of cross-section of filaments obtained by joining and dividing two spinning materials at a number of stages successively.
Figure 7:
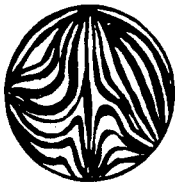

When two spinning materials, such as nylon-6 and nylon-66, having similar chemical and physical properties and mutual affinity are joined and divided in different phase in the above-mentioned layer-multiplying process, the resulting mixed filament has a cross-section having "grainy" multi-layer configuration as shown in FIGS. 5 – 7. The grainy multi-layer configuration is maintained, even when such joining and dividing are carried out at more than 10 stages. FIG. 6 is an embodiment of regular grainy multi-layer configuration. FIG. 7 is an embodiment of distorted grainy multi-layer configuration. Such a configuration is caused by the disturbance of the flows of the spinning materials in a spinning apparatus, particularly in a layer-multiplying mixer, and has an advantage that the contacting area between the components increses and therefore the bonding between the components strengthens.

Figure 8:
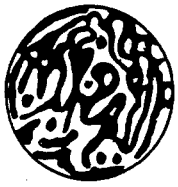

On the contrary, when spinning materials having no mutual affinity or adhesivity are layer-multiplied by joining and dividing in different phase, the cross-section of the resulting filament has grainy configurations as shown in FIGS. 5 – 7 in the case when the number of stages of joining and dividing is small, while the crosssection of the resulting filament is transformed into an "archipelagic" configuration as shown in FIG. 8 as the number of stages of joining and dividing increases.

The term "archipelagic multi-layer configuration" used herein means such a configuration that there are considerably large number of flat layers composed of at least one component at the cross-section having a configuration, in which at least two components are mixed in the form of multi-layers, as if a large number of slender islands are scattered in the ocean.

Furthermore, the inventors have found that if the number of stages of joining and dividing, when such an archipelagic multi-layer can be obtained, is further increased, the resulting multi-layer filament has a "nebular" configuration at the cross-section, and the present invention has been accomplished.

That is, the filament according to the invention consists in a novel mixed filament, characterized in that at least two components having poor mutual affinity are mixed in the form of a nebula in at least one portion of the cross-section of the unitary filament and that the nebular configuration is substantially continuous along the longitudinal direction of the filament.

The method of producing the mixed filament according to the invention is characterized in that at least two spinning materials having poor mutual affinity are subjected to the joining and dividing in different phase as mentioned above, in which said spinning materials are joined and the joined spinning materials are divided while maintaining the joined state at least partly, repeatedly at least 8 times, whereby the spinning materials are layer-multiplied and the nebular configuration is formed at the cross-section, and then the resulting spinning material flow is extruded through an orifice.

As described above, the filament of the present invention has a nebular configuration at least in one portion of the cross-section. The term "nebular configuration" used herein means such a configuration that at least one component is irregularly dispersed in the other component in the form of circles, ellipses or other similar shapes, in various sizes and shapes as stars in nebula. A filament having a double-structure, wherein a star corresponding to one component locates in a star corresponding to the other component, or a filament, wherein "star" (isolated component) and "sky" (background component) are present in replaced state concurrently in a unitary filament, may be formed depending upon the kind of spinning materials.

The number of "stars" constituting the nebula should be at lest 50, preferably more than 100, and particularly more than 200. When the number of stars is too small, the mixing has not been effected sufficiently finely and the uniformity is poor. It is very easy to obtain a nebular configuration containing more than 50 stars by the above-mentioned method, and nebular configurations containing several hundreds to several thousands stars are used in practice.

When the size of stars is too large, fibrillation of filament is liable to occur due to the separation between components, and nebular configurations containing such large stars are not preferable. The maximum dimension of the cross-section of the largest star (when the star is circular, this dimension is the diameter of the star) should be less than ¼, preferably less than 1/10 of the maximum dimension of the cross-section of a filament (when the cross-section of the filament is circular, this dimension means the diameter thereof) and similarly the average dimension of the cross-sections of stars should be less than 1/10 of the maximum dimension of a filament.

In the present invention, the above-mentioned nebular configuration is substantially continuous along the longitudinal direction of the filament. That is, every component continues substantially along the longitudinal direction of the filament. Very fine stars may be needle- or granule-like along the longitudinal direction of the filament, but main stars continue at least several centimeters, usually from several tens to several hundreds centimeters or more along the longitudinal direction of the filament.

Figure 9:
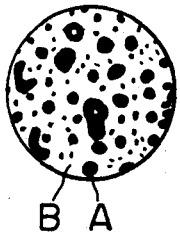

FIG. 9 shows one embodiment of a cross-section of a filament having a nebular configuration, in which the component A forms stars and the component B forms sky (back ground). Other embodiments of cross-section having a nebular configuration are shown in photomicrographs of FIGS. 26 – 31, and the characteristics may easily be understood.

Figure 10:
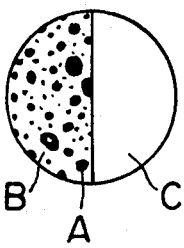
Figure 11:
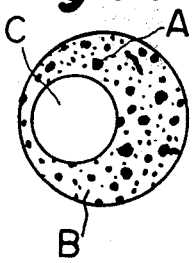
Figure 12:
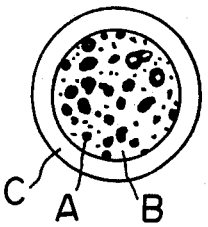
Figures 13, 14:
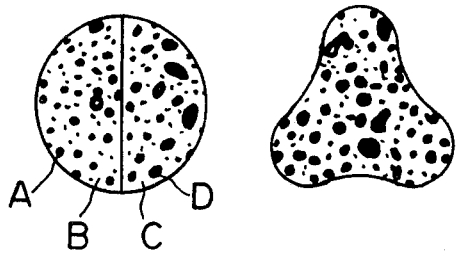

The filaments according to the invention have a nebular configuration wholly or partly at the cross-section, and a portion of the filament may be other configurations. FIGS. 10 – 12 show embodiments of cross-sections of composite filaments, wherein a nebular configuration portion composed of components A and B and another portion composed of component C are bonded. Filaments having eccentrically bonded configurations as shown in FIGS. 10 and 11 have latent crimpability. A nebular configuration composed of components A and B and another nebular configuration composed of components C and D may be bonded as shown in FIG. 13.

Figure 17:
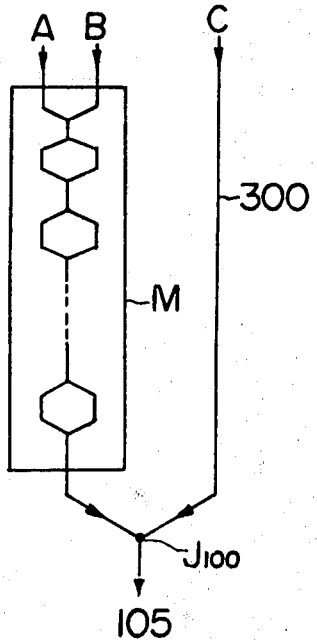
Figure 23:
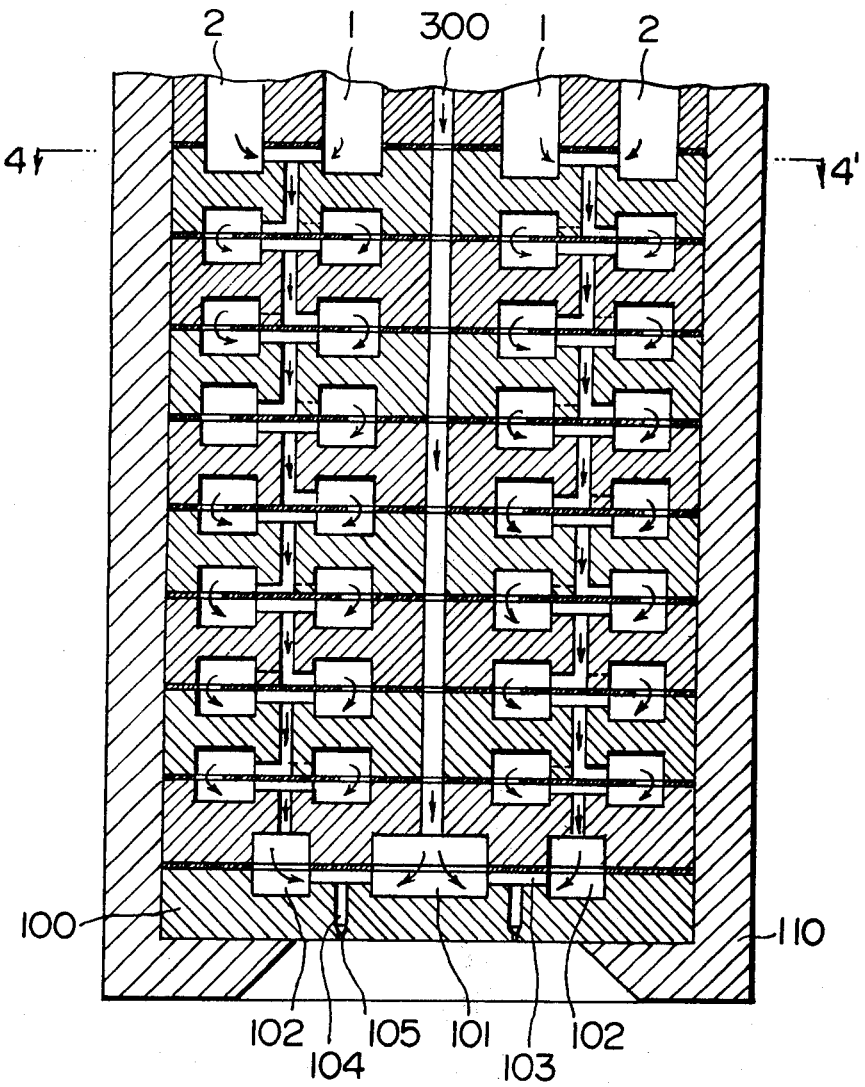

Filaments as shown in FIGS. 11 – 12 can be produced very easily. That is, such filaments can be produced by conjugate spinning a spinning material flow layer-multiplied in nebular configuration in the cross-section and another spinning material flow in a conventional process. FIG. 17 is a model diagram showing the above-mentioned method. FIG. 23 is an embodiment of a spinneret to be used for carrying out the method as shown in FIG. 17.

Figure 18:
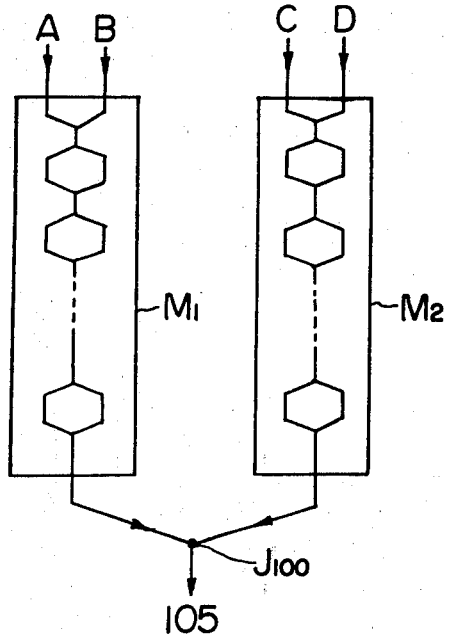

In FIG. 17, two components A (for example, polyamide) and B (for example, polyester) are layer-multiplied in a layer-multiplying mixer M. In the mixer M, the two spinning materials A and B are layer-multiplied, for example, in a manner as shown in FIG. 15. The third component C and the above-mentioned layer-multiplied components A and B flowed out from the layer-multiplying mixer M are joined at a point $J_{100}$ in a conventional manner, and then extruded through an orifice 105. In the method shown in FIG. 17, the component C may be the same with the component A or with the component B, or the component C may be different from both the components A and B. Similarly, it will be apparent that the filament having a configuration as shown in FIG. 13 can be obtained in the manner as shown in FIG. 18. In FIGS. 13 and 18, the component A may be the same with the component C or with the component D, or the component B may be the same with the component C.

A method of producing the filament according to the present invention will now be described more fully with reference to the embodiments shown in the drawings.

Figure 19:
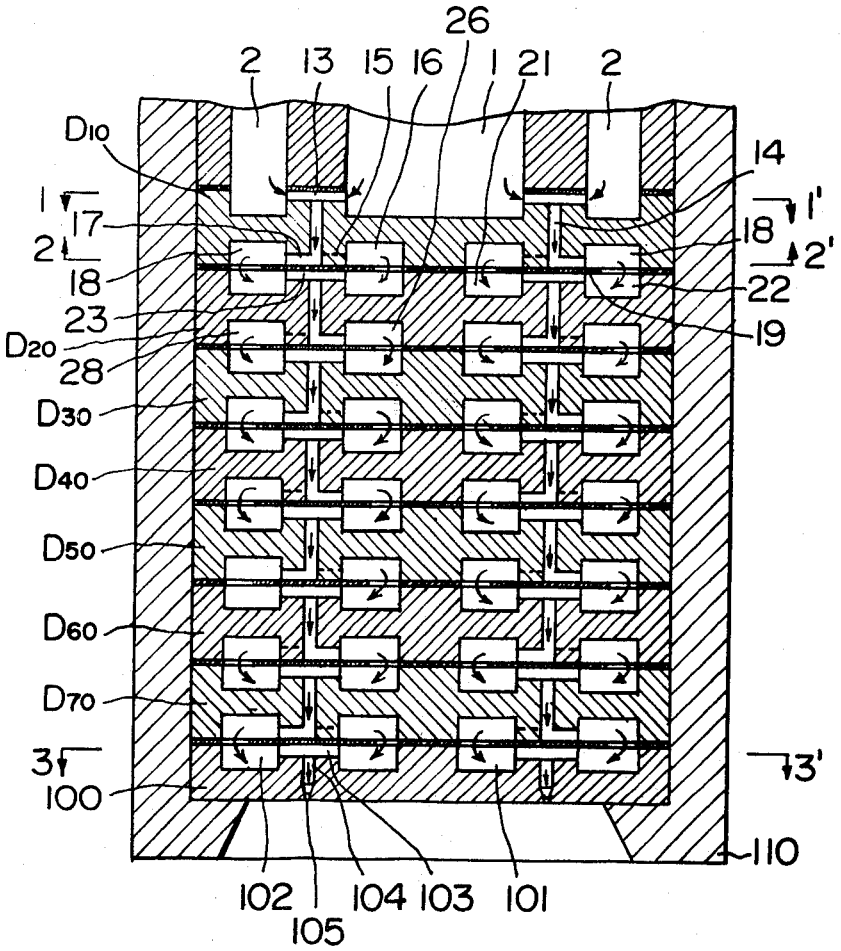

FIG. 19 is a longitudinal-sectional view of an embodiment of the spinneret to be used for spinning the filament of the present invention, which spinneret is assembled by seven distributing plates, $D_{10}$, $D_{20}$, $D_{30}$, $D_{40}$, $D_{50}$, $D_{60}$ and $D_{70}$ and a spinneret plate 100 into a unit within a holder 110 and shows the detailed construction of the spinneret, the manner of multiplying layers, the relation of connection between said distributing plates and reservoirs 1 and 2 fed with two spinning materials and the relation of connection between the distributing plate $D_{70}$ and the spinneret plate 100. The flow of the spinning material is shown in directions of arrows.

It can be seen from FIG. 19 that two spinning materials are fed into reservoirs 1 and 2 which form supply sections of the spinneret, respectively by means of metering pumps. The spinning materials in the reservoirs 1 and 2 are joined at the center of channels 13. One group among a plurality of ducts 14 connecting to the center portions in the channels 13 is connected to inner reservoir 16 through inner distributing channels 15. A part of the above joined spinning materials flows into the inner reservoir 16 through the above described ducts 14 and inner distributing channels 15. Another group of a plurality of the ducts 14 are connected to outer reservoir 18 through outer distributing channels 17 and thereby the other part of said materials flows into the outer reservoir 18. 19 designates separating plate or gasket for separating ditches (distributing channel 15 and 17) provided on the bottom surface of the distributing plate $D_{10}$ from channels 23 provided on the upper surface of the distributing plate $D_{20}$. But the gasket 19 does not separate the reservoirs 16 and 21. The reservoirs 18 and 22 are also interconnected (because the gasket 19 has a suitable opening).

The spinning materials in the reservoirs 16 and 18 flow into the reservoirs 21 and 22, respectively and then are joined in a channels 23 introducing into two reservoirs 26, 28 of the third stage. The spinning materials are subjected to repeatedly the joining and dividing process subsequently in the same manner to multiply layers and finally flow into last reservoirs 101 and 102 from which the materials are introduced into channels 103 and joined at the center thereof. Thus joined materials flow into ducts 104 and then are spun through orifice 105. The number of ($n$) of stages of the joining and dividing step in the spinneret shown in FIG. 19 is 8. The number ($n$) may be easily varied by varying the number of the distributing plates.

Figure 20:
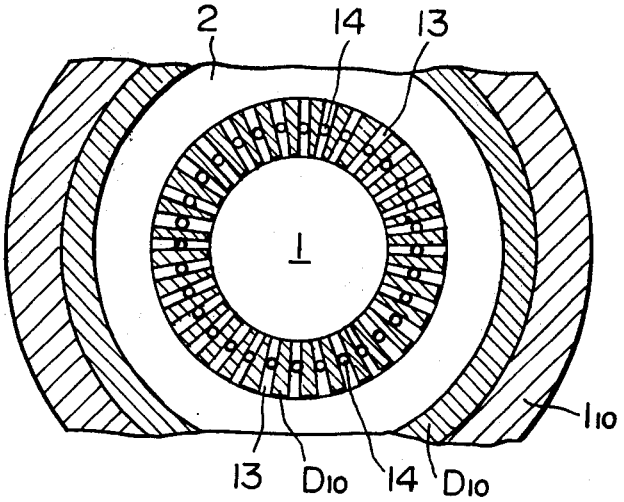
Figure 21:
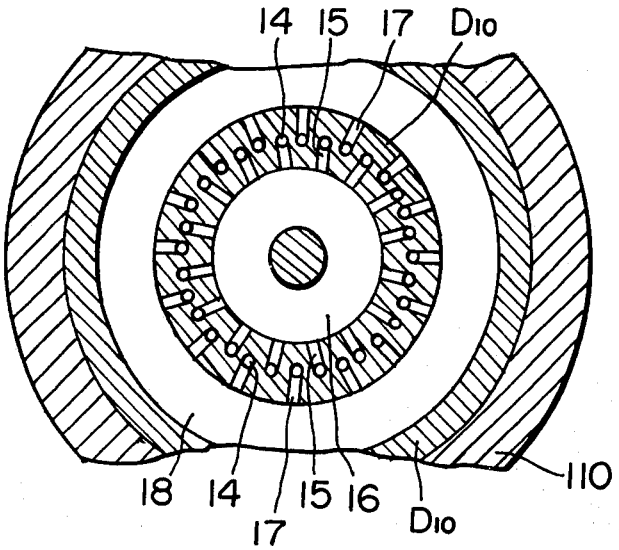
Figure 22:
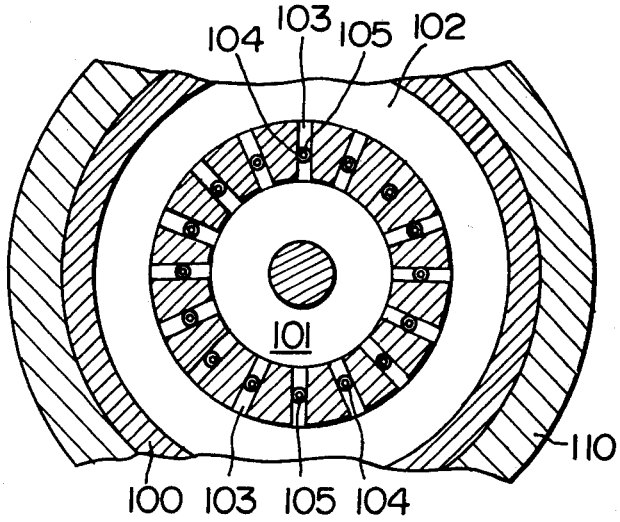

FIG. 20 is a cross-sectional view taken along the line 1–1′ of FIG. 19 and viewing in the direction of the arrows to show the arrangement of the reservoirs 1 and 2, channels 13 and ducts 14. FIG. 21 is a cross-sectional view taken along the line 2–2′ of FIG. 19 and viewing in the direction of the arrows and shows the distributing channels 15 being opened to the inner reservoir 16 and the distributing channels 17 being opened to the outer reservoir 18. It can be understood that a part of two spinning materials joined at the center of the channels 13 is introduced into the inner reservoir 16 and the other part is introduced into the outer reservoir 18 through the ducts 14 while the materials maintain the joined condition. FIG. 22 is a cross-sectional view taken along the line 3—3′ of FIG. 19 and shows the arrangement of the channels 103, ducts 104 and orifice 105.

It can be seen from FIGS. 19 and 20 that the joining direction of the spinning material in the channels 13, 23 and the like is identical with the direction of the channels, namely with the radial direction of the distributing plates D. The division of the spinning materials is effected in the reservoirs and the direction thereof is identical with the direction of arrangement of said channels, namely with the peripheral direction of the spinneret. The phases of the joining and the dividing steps are different by 90° from each other.

Figure 24:
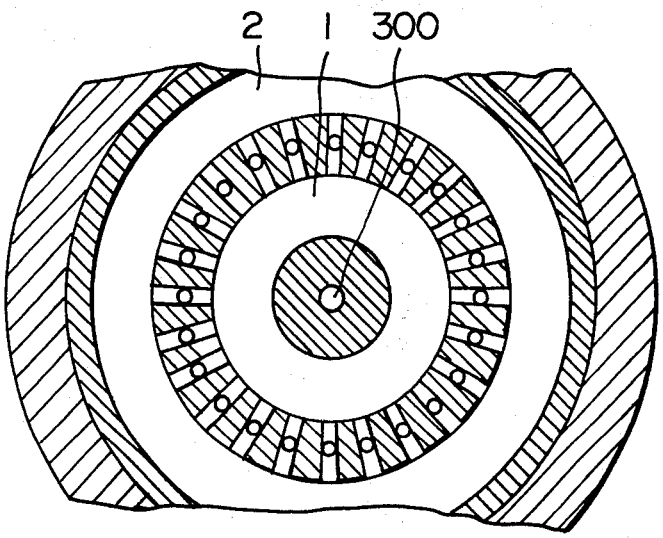

FIG. 23 shows an embodiment of the spinneret to be used for carrying out the method above-mentioned and referring to FIG. 17. In the spinneret shown in FIG. 23 two spinning materials A and B are fed to the reservoirs 1 and 2 and introduced into the reservoir 102 after layer-multiplying. While a spinning material C flows through duct 300 into a reservoir 101 and is joined at the center of the channel 103 with the spinning materials A and B which have been mixed to as to form a multi-layers and finally spun through the orifice 105. The method of mixing the spinning materials A and B in the spinneret shown in FIG. 23 is the same as that of the spinneret shown in FIG. 19. FIG. 24 is a cross-sectional view taken along the line 4–4′ of FIG. 23 and viewing the arrangement of the reservoirs 1 and 2 and duct 300.

The layer-multiplying mixer of the spinneret shown in FIGS. 19 and 23 carries out the joining steps in the narrow channels and the dividing steps in the reservoirs. Various spinnerets of the layer-multiplying mixer type having reservoirs, in one of which the joining step is carried out in the reservoirs and the dividing step is carried out in the narrow channels, and in the other of which both the steps are carried out in the reservoirs, may be utilized for the present invention. A layer-multiplying mixer formed by a three-dimensional flow network comprising a narrow channels may be also used for the present invention.

In general, when the number of the stages of the layer-multiplying mixer increases for a plurality of spinning materials having poor mutual affinity, the configuration of the cross-section of the resulting filament varies gradually. For example, when polyester and polyamide are spun by means of the spinneret as shown in FIG. 19, if $n$ is 2 to 5 (the distributing plate D is 1 to 4), grainy configuration is obtained, if $n$ is 5 to 6 (the distributing plate D is 4 to 5), archipelagic configuration is obtained and if $n$ is 8 or more, particularly 10 or more, nebular configuration is obtained. Particularly, the layer-multiplying mixer provided with reservoirs are very suitable for obtaining nebular cross-sectional configuration of the object of the present invention, because the spinning material flow is disturbed and divided in the reservoirs.

From the above illustration it will be apparent that the fibers of the present invention can be produced efficiently by an apparatus having a very simple structure.

Then, an explanation will be made with respect to combinations of the spinning materials of the present invention. According to the present invention, at least two spinning materials having no mutual affinity are used. The affinity of two components can be judged by the adhesivity between the two components. For example, when these components are conjugate spun in a side-by-side relation by a melt spinning, if the resulting composite filament is easily separated by drawing or bending to form fibrils, these components are judged to be no affinity. Furthermore, if the nebular configuration is obtained in the cross-section of a filament through a spinning by means of a spinneret as shown in FIG. 19, the components composing such a filament are judged to be no or poor affinity. Combinations showing a complete affinity in melt spinning is, for example, nylon-6 and nylon-66 or polyethylene terephthalate and polyethyleneoxybenzoate. In many cases, different polymers have poor mutual affinity.

Useful combinations among the combinations of polymers having poor affinity are exemplified.

The first combination is one of polymers having different dynamic properties. An improved fiber can be obtained by mixing spinning materials having different strengths, elongations, Young's moduli and recoveries for elongation and the combination of polyamide and polyester is typical for such a purpose. However, when polyamide and polyester are merely mixed and spun through a screw extruded, the recovery for elongation and strength are often rather reduced and in order to obtain excellent fibers, it is necessary to adopt a particular technique. According to the present invention, the fibers having an improved tensile strength can be obtained very easily.

The second combination is one of polymers having different electrical properties, such as electric resistance and polarity of frictional charge. Polyamides and polyesters have generally a high electric resistance, while polyalkylene glycols (polyalkylene oxides) have a low electric resistance and consequently the polyamides and polyesters can be improved by mixing the polyalkylene glycols. In many cases, polyamides are charged positively by friction, while polyesters and polyolefins are charged negatively. It is possible to decrease an apparent charge by mixing a polymer to be charged negatively and a polymer to be charged positively to neutralize their charges. For the purpose, it is particularly preferable that both the polymer to be charged positively and the polymer to be charged negatively are present in the surface of the filament and the present invention is suitable for this purpose.

Furthermore, the present invention can improve dyeability, touch, gloss and the like of fibers. Particularly, in the fibers of the present invention at least two components can occupy the surface in a finely mixed state and the waxy touch of a disadvantage of synthetic fibers can be improved.

The fibers of the present invention can be used for production of many fibrous products in forms of filament, staple fiber, yarn and the like are very useful.

Embodiments of polymer combination will be mentioned hereinafter.

Polyamides and polyesters can provide excellent mixed fibers easily by the present invention. Though polyesters and polyamides, in general, have substantially no adhesivity, in the resulting mixed filaments the tendency of fibrillation is improved and substantially no problems occur in practice. In addition, for example, when a polyester and a polyamide are mix spun in a mixing ratio of 1:1 through a screw extruder, the resulting filament is often considerably poor in strength but according to the present invention such a defect does not occur and the filament obtained from polyamide and polyester by the present invention is improved in frictional charge, and this reason will be based on the fact that the components occupy the surface of the filament and therefore the frictional charges are neutralized. The mixing ratio of polyester and polyamide can be selected optionally but is generally about 1/10 – 10/1, particularly 1/4 – 4/1.

Another characteristic of the fibers composed of polyester and polyamide is that the filament itself is opaque. Namely, polyamide and polyester are different in the refractive index from each other and consequently light is reflected irregularly due to the nebular configuration annd the filament is delustered and as the result it is possible to obtain considerably delustered filament without adding any delustrant and the gloss of the filament obtained from the delustered mixed filament is unique.

When a polyester and a polyamide are mix spun according to the present invention, in many cases, the polyamide forms star and the polyester forms sky (background) in the part of nebular configuration of the resulting filament. (Of course, there may be the reverse case.) This is presumably due to the fact that the self aggregation, when the polyamide is melted, is higher than that of the polyester. This phenomenon is substantially same in any case when the mixing ratio of polyamide and polyester is 1/1, 3/1 or 1/3.

The polyamides to be used in the present invention are well-known fiber-forming polyamides, for example, nylon-6, nylon-7, nylon-11, nylon-12, nylon-66, nylon-610, polyhexamethylene isophthalamide (nylon-6I), polyhexamethylene terephthalamide (nylon-6T), poly-p-xylylene dodecanamide (PXD-12) or the modified products, copolymers or blends thereof and the like. However, nylon-11, nylon-12, PXD-12 and the like are liable to be charged negatively depending upon the production conditions, and therefore care must be taken in the production of mixed filaments with polyolefins for the purpose of neutralizing the charge.

The polyesters to be used in the present invention include well-known fiber-forming polyesters, polyesteramides and polyester-ethers. As the above polyesters, for example, mention may be made of polyethylene terephthalate, poly-1,4-bis(hydroxymethyl) cyclohexane terephthalate or the copolymers, modified products or blends consisting essentially of polyethylene terephthalate (containing, for example, more than 80%). As the above polyester-ethers, mention may be made of polyethylene oxybenzoate or the copolymers, modified products or blends containing essentially of polyalkylene oxybenzoate and as the above polyesteramides, mention may be made of polymers obtained by reacting diol and dicarboxylic acid, polymethylene-bis-(ammonium alkylterephthalate) and glycol or polymethylene-bis(alkylterephthalate) and diamine or oxyacids containing amide linkage or the modified products or blends thereof.

The combination of polyamide and polyalkylene oxide will be explained hereinafter.

Polyamide fibers have excellent dynamic properties and heat resistance and can be used in a broad field. However, the polyamide fibers have a high charging property and a low electric conductivity as in the case of the other synthetic fibers, such as polyester fibers and the like and consequently it has been well-known that if any antistatic means is not adopted, a considerable difficulty occurs in operations of melt spinning, drawing, twisting, warping, weaving or knitting, finishing and the like. Furthermore, the knitted goods or woven fabrics composed of olyamide fibers have a high charging property and therefore they are liable to be stained and give unpleasant feeling, when they are put on or taken off.

Figure 1:
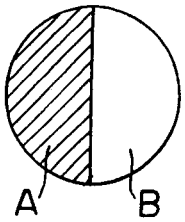
FIG. 1 is an embodiment of cross-section of a filament obtained by one time joining.
Figure 2:
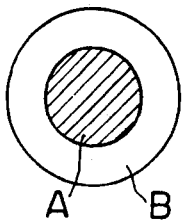
Figure 3:
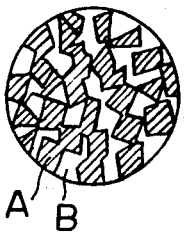
Figure 4:
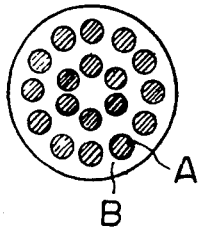

Hithertofore, various proposals have been made in order to improve these defects and one of them is to use antistatic oils, but the oils are very poor in the washing resistance and it is difficult to obtain the permanent effect. For the purpose of providing the antistatic property semipermanently to polyamide fibers, it has been conceived that a polyamide is mixed with a polyalkylene oxide having a high electric conductivity and a mixed filament composed of such a mixture and a method for producing such a filament have been proposed. However, the polyalkylene oxides are generally poor in the fiber-forming ability and also in the dynamic property, so that there have been a large number of problems in the mixing with the polyamide and it has been difficult to obtain mixed filament having excellent dynamic property and high uniformity. For example, a filament, wherein polyalkylene oxide is dispersed in an elongated granular state having a diameter of 0.1 to 0.4 $\mu$ and a length of at least 8 $\mu$ in polyamide has been proposed. The mixed filament obtained by mixing such fine granules has discontinuous configuration and namely polyamide having a low electric conductivity exists between polyalkylene oxide granules, and accordingly, the electric conductivity of the mixed filament cannot be necessarily satisfied, even if the electric conductivity of polyalkylene oxide is high. As the defects due to the discontinuous configuration resulting from the fine granular mixture of both the polymers, low strength, resistance against tensile bending, recovery for elongation and poor fatigue resistance and resistance against repeating elongation and bending are cited For production of fibers having an excellent dynamic property and an improved antistatic property by mixing polyamide and polyalkylene oxide, it is preferable that polyamide and polyalkylene oxide have continuous configuration in the longitudinal direction of the filament. Particularly, the multi-layer filaments are preferable, because they have a large area contacting the spinning materials with each other. However, undesirably the conventional side-by-side type multi-layer filaments (as shown in FIG. 3 or 6) cause separation between the components. On the other hand, the multi-core filament as shown in FIG. 4 needs a very complicated spinning apparatus for production of such a filament and an increase of cores for increasing the contacted area of both the polymers is limited. For example, it is difficult to increase the number of cores to more than 10 and the increase of more than 50 is impossible commercially. Furthermore, an essential defect of multi-core filament is that the core component does not occupy the surface of filament. Namely, in order to mix a small amount of polyalkylene oxide in polyamide in a form as shown in FIG. 4, polyalkylene oxide should form the core component and consequently polyalkylene oxide does not occupy the surface of filament and the antistatic property of the filament is not substantially improved.

According to the present invention it is possible to obtain novel mixed fibers composed of polyamide and polyalkylene oxide, in which the foregoing defects are obviated. Namely, filaments having nebular configuration in cross-section can be easily obtained from polyamide and polyalkylene oxide by the above-mentioned layer-multiplying process.

When polyamide and polyalkylene oxide are mixed in the nebular multi-layer configuration according to the present invention, the component corresponding to the background for the nebula and the component corresponding to the star are not defined, and moreover, a star having a double structure, wherein a small star composed of one component locates in a large star composed of the other component, may be formed. It depends upon the mixing ratio, melt viscosity, aggregating property and the like for component to form star, and polyalkylene oxide often forms the star.

In the usually obtained nebular configuration, in many cases about 200 to 10,000 stars disperse in the cross-section of unitary filament and it is difficult to enumerate the number of star correctly. The number of star, when a small star composed of one component locates in a large star composed of the other component, means one enumerated by summing the number of large and small stars.

The mixing ratio (by weight) of polyamide and polyalkylene oxide composing the mixed filament of the present invention can be selected freely depending upon the object and it is within the range of polyamide/polyalkylene oxide from 20/80 to 98/2 in practice and this point will be explained hereinafter. The dynamic property and heat resistance of the filament decrease with increase of the rate of polyalkylene oxide and the antistatic property reduces with decrease of the rate of polyalkylene oxide and therefore the satisfactory result cannot be obtained beyond the above described mixing ratio.

The first advantage resulting from the fact that in the mixed filament of the present invention polyamide and polyalkylene oxide form nebular multiconfiguration in the cross-section of the filament lies in that the contacted area between the components is large, the polyalkylene oxide having a high electric conductivity occupies a part of the surface of the filament and both the components form substantially continuous configurations, so that the charge generated due to friction easily conducts and diffuses and as the result this filament has an improved antistatic property.

The second advantage lies in that polyalkylene oxide having a low friction resistance and a high smoothness occupies a part of the surface of the filament, so that the generation of frictional electricity is lessened few.

The third advantage lies in that the filament has finely and continuously mixed configuration, so that the fibrillation owing to external stress is very few.

The fourth advantage lies in that polyamide and polyalkylene oxide are different from each other in the refractive index and therefore light is reflected irregularly due to the nebular configuration and the filament is delustered. As the result, it is possible to obtain considerably delustered filament without adding any delustrant and the gloss obtained from this delustered mixed filament is unique.

The term "polyalkylene oxide" used herein means, for example, polymers of low molecular weight alkylene oxide, such as, polyethylene oxide, polypropylene oxide, and the copolymers and modified products of these polymers and the derivatives, wherein the terminals of these polymers are substituted with other substances, in which the main component (more than 50% by weight) is constituted with alkylene oxide.

Useful groups by which the terminals of polyalkylene oxide are substituted, include alkyl or aryl group (ester linkage or ether linkage), inorganic acid groups, such as, phosphate group or sulfonate group and the like (ester linkage), organic acid groups, such as oxalate group, adipate group, trimellitate group, terephthalate group and the like, and the complexes or mixtures thereof.

The substances containing the above described sulfonate or phosphate group have particularly high electric conductivity and are suitable for production of fibers having a high antistatic property. For example, a substance wherein polyalkylene oxide bonds through phosphate group to a different group, for example, alkyl group or a polymer, for example, polyester, is also useful. The substances containing any substitute other than the above described groups or the copolymers are useful, if the main component is polyalkylene oxide. However, segmental elastomers obtained from polyalkylene oxide and diisocyanates, which are useful for spandex, are not suitable for the present invention in view of hydrophilic property and antistatic property.

The average molecular weight of polyalkylene oxide to be used in the present invention may vary depending upon the object, but in most case, polyalkylene oxides having an average molecular weight of more than 500, usually more than 10,000, can be used.

The "average molecular weight" used herein means an average of molecular weights of two polyalkylene oxides, when a low molecular weight polyalkylene oxide and a high molecular weight polyalkylene oxide are mixed. For example, the average molecular weight, when polyethylene glycol having a molecular weight of 1,000 and polyethylene glycol having a molecular weight of 10,000 are in an equal weight, is about 1,800 (number average molecular weight).

Polyalkylene oxide has usually such a tendency that the lower the molecular weight, the higher the hydrophilic property and the electric conductivity are and the higher the molecular weight, the lower the hydrophilic property is. Furthermore, the melt viscosity of polyalkylene oxide is smaller in the polymer having a lower molecular weight and is larger in the polymer having a high molecular weight. In the production of mixed filament composed of polyalkylene oxide and polyamide, it is advantageous to use polyalkylene oxide having a higher molecular weight (more than 20,000 particularly, 50,000 to 400,000) in view of the spinnability, because the difference of the melt viscosity between polyamide and polyalkylene oxide is small. Moreover, it is preferable to use polyalkylene oxide having a higher molecular weight in order to maintain the antistatic property and smoothness semipermanently. When a polyalkylene oxide in the filament has a very high molecular weight (particularly, more than 200,000), the water solubility is low and the filament containing such a polyalkylene oxide gives antistatic effect having water resistance.

When it is attempted to produce the filament having a high antistatic property by using polyalkylene oxide containing sulfonate group or phosphate group having a high electric conductivity, the lower the molecular weight of the polyalkylene oxide, the larger the number of moles of sulfonate group or phosphate group is, so that such a polyalkylene oxide is useful. In such a case, it is preferable to use a mixture of low molecular weight polyalkylene oxide containing many sulfonate groups or phosphate groups and a high molecular weight polyalkylene oxide. Since a low molecular weight polyalkylene oxide, particularly, polyethylene oxide is high in water solubility and permeability, it is possible to obtain porous filament by dissolving off the polyalkylene oxide from the mixed filament by means of water after mix-spinning with polyamide. In this case, it is also possible to adjust the melt viscosity properly by mixing a low molecular weight polyalkylene oxide and a high molecular weight polyalkylene oxide.

The present invention has a characteristic that even if the mixing ratio of polyalkylene oxide is larger, the spinnability and drawability do not substantially decrease. For example, in order to produce porous filament (including staple fiber), the mixing ratio of polyalkylene oxide may be 5 to 80%. When a filament having a high mixing ratio of polyalkylene oxide is extracted with water, such a filament shows a particularly fibrillated configuration. The fact that polyalkylene oxide can be extracted with water in the production of porous filament (including staple fiber) or fibrillated filament, is extremely more advantageous commercially than use of polystyrene and it is also advantageous commercially to be able to effect melt spinning together with polyamide (for example, PVA cannot be subjected to melt-spinning). In order to provide the antistatic property to the filament, the mixing ratio of polyalkylene oxide is 2 to 30%. In addition, well-known antistatic agents may be used together and as mentioned above, the polyalkylene oxides containing substituents having a high antistatic activity (sulfonate group or phosphate group) are useful.

In order to provide hydrophilic property to the filament, the mixing ratio of polyalkylene oxide is preferably 2 to 50%. The mixing ratio is sufficient in about 2 to 10% merely to remove water repellent property and make wettable in water, but in order to provide a sufficient hydrophilic property and water absorbing property, the mixing ratio is 10 to 50%.

Then an embodiment of a combination of polyester and polyalkylene oxide will be explained.

It has been well-known that the antistatic property of polyester is improved by mixing polyalkylene oxide to polyester, but the conventional mixed fibers having granular configuration have many defects as mentioned in the case of polyamide and polyalkylene oxide. Polyester and polyalkylene oxide can be easily mix spun according to the method of the present invention in substantially the same manner as in the case of polyamide and polyalkylene oxide, whereby excellent fiber can be produced. In the nebular configuration usually obtained from polyester and polyalkylene oxide, above 200 to 10,000 stars often disperse in the crosssection of the unitary filament and it is considerably difficult to enumerate the number of stars correctly. When polyester and polyalkylene oxide are mixed in nebular multilayer configurations, the component corresponding to the background of the nebular and the component corresponding to the star are not defined. Furthermore, stars having double structure may be formed, in which a small star composed of one component locates in a large star composed of the other component. It is determined by mixing ratio, melt viscosity, aggregating property and the like, which component constitutes star, but in many cases polyalkylene oxide forms star.

The mixing ratio by weight of the polyester and polyalkylene oxide composing the mixed filament of the present invention can be selected optionally depending upon the object as in the case of polyamide and polyalkylene oxide and the mixing ratio of polyester/polyalkylene oxide is usually within the range from 20/80 to 98/2.

The first characteristic of the mixed filament composed of polyalkylene oxide and polyester obtained by the present invention lies in that the production is easy as in the case of polyamide and polyalkylene oxide.

The second characteristic lies in that the components have substantially continuous configurations in the longitudinal direction and therefore, the dynamic property scarcely decreases and the electric conductivity is high.

The third characteristic lies in that polyalkylene oxide occupies the surface of filament and consequently the antistatic property for friction is high and the smoothness is good.

The fourth characteristic lies in that the fibrillation is few.

The fifth characteristic lies in that the filament has a unique gloss.

The sixth characteristic lies in that porous fiber can be obtained easily.

Further, the combination of polyamide and polyolefin will be explained.

The polyamide is charged positively by friction in most case, while the polyolefin is charged negatively by friction. When polyamide having positively charging tendency and polyolefin having negatively charging tendency are mixed and spun in a proper mixing ratio, it can be expected that filament neutralized electrically and having an excellent antistatic property can be obtained.

However, the polyamide and the polyolefin are considerably different in the chemical and physical properties, so that the mix spinning of these polymers has many problems in conventional process. These are common to the phenomena already mentioned and in brief these defects consist in fineness of mixture, continuousness of the mixed configuration, fibrillation, and the surface condition. The present invention can give fibers having improved dynamic property, electric property, gloss, touch and the like from polyamide and polyolefin.

The polyamides to be combined with the polyolefin may be those well-known. Nylon-11, nylon-12, PXD-12 and the like are liable to be charged negatively by friction depending upon the production process, the kind and amount of terminal group and polyamides (PACM-9, PACM-12, etc.) obtained from p-amino(-bis)cyclohexylmethane)PACM) and a long chain dicarboxylic acid (azelaic acid, decanemethylene dicarboxylic acid, etc.) are liable to be charged negatively by friction, so that the object of neutralizing the charge cannot be attained by combining polyolefin, but the dynamic property can be improved.

The "polyolefins" used herein are, for example, homopolymers of ethylene, propylene, butylene and the copolymers and blends consisting essentially of these polymers. As the monomers capable of copolymerizing with olefin, for example, vinyl acetate, vinyl chloride, fumaric acid, maleic acid, acrylic acid, methacrylic acid and the like have been well-known. Moreover, the modified products obtained by partially oxidizing polyolefin and containing ether group, carboxyl group and the like in the molecular chain are also useful.

The substances, in which the terminal or the side chain of polyolefins has substituent, such as halogen, aryl group, inorganic acid groups, for example, phosphate group, sulfonate group and the like or organic acid groups, for example, oxalate group, adipate group trimellitate group, terephthalate group and the like, are also useful. The above described substances containing sulfonate group or phosphate group are suitable for production of fibers having particularly high electric conductivity and excellent antistatic property. The substance, wherein polyolefin is bonded through phosphate group to the other group or polymer, is also useful. The substances containing any substituent other than the above described groups or the copolymer, in which the main component is polyolefin, may be used for the present invention.

The mixing ratio of polyolefin and polyamide can be selected optionally depending upon the object, However, if the rate of polyolefin increases, the dynamic property and heat resistance and the like of the filament decrease. On the other hand, if the rate of polyolefin is too small, the antistatic activity of filament cannot be attained. The mixing ratio of both the polymers is usually 1/10 – 10/1, preferably, 1/1 – 1/10. It is not defined which component constitutes the star in the nebular configuration. In the combination of nylon-6 and polypropylene, polypropylene often forms star and in the combination of nylon-6 and polyethylene, in many cases nylon-6 forms star or the star of nylon-6 and the star of polyethylene coexist.

The invention will be explained further in detail by the following Examples:

In Examples, the charged voltage due to friction of the yarn was determined in the following manner. The previously discharged yarn was run at a velocity of 200 m/min. and contacted with alumina ceramic having a diameter of 10 mm four times at an angle of 90° (in total 360°) and then passed through a detector of static electricity. The detecting method is a vibration capacity process and the yarn does not contact with the detector.

The recovery for fatigue in Examples is recovery ratio when a sample filament is elongated 10% and then the elongation is recovered and such a process is repeated 30 times.

EXAMPLE 1

Nylon-6 having an intrinsic viscosity of 1.15 in m-cresol at 30°C and polyethylene terephthalate (hereinafter abridged as PET) having an intrinsic viscosity of 0.45 in m-cresol at 30°C were mix spun by means of two spinnerets as shown in FIG. 19, one of which was provided with three distributing plates, that is, the number of joining and dividing in the layer-multiplying step was 4, and another of which was provided with twelve distributing plates (number of joining and dividing step: 13). In either case, the spinneret temperature was 280°C.

The melted nylon-6 was fed to the reservoir 1 and the melted PET was fed to the reservoir 2 by gear pumps in equal amount respectively, and both the spinning materials were joined and divided through the given distributing plates and layer-multiplied and then extruded through orifices 105 into air and the thus spun filaments were cooled and wound up on a bobbin. The undrawn filaments thus formed were drawn 3.9 times their original length on a draw pin at 90°C to obtain drawn filaments of 70 d/18 *f*. The thus obtained drawn filament, when the number of joining and dividing step is 4, is referred to as the filament $F_1$ and the drawn filament, when the number of joining and dividing step is 13, is referred to as the filament $F_2$ below.

Figure 25:
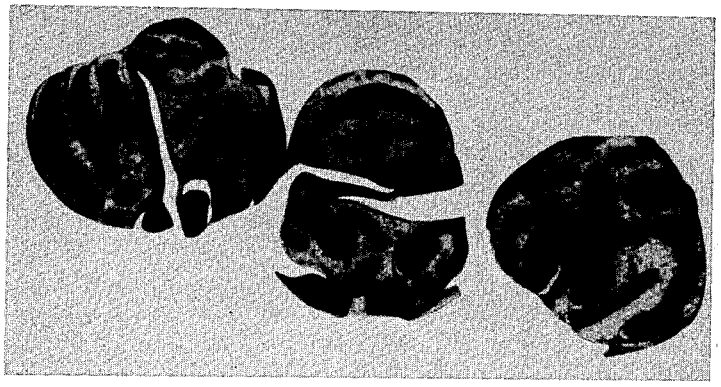

A photomicrograph of a cross-section of the filament having particularly large fineness, which is obtained when the take-up velocity is lowered particularly in the spinning of the filament $F_1$, is shown in FIG. 25. A cross-section of the filament $F_1$ is considered to be similar to that of FIG. 25. A photomicrograph of a cross-section of a filament obtained in the same manner, provided that the number of joining and dividing step is 10, is shown in FIG. 26 and a photomicrograph of a cross-section of the filament $F_2$ (n=13) is shown in FIG. 27.

Figure 26:
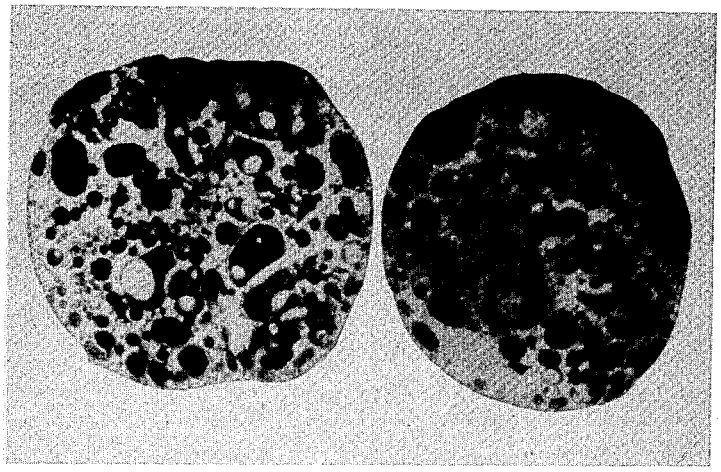
Figure 27:
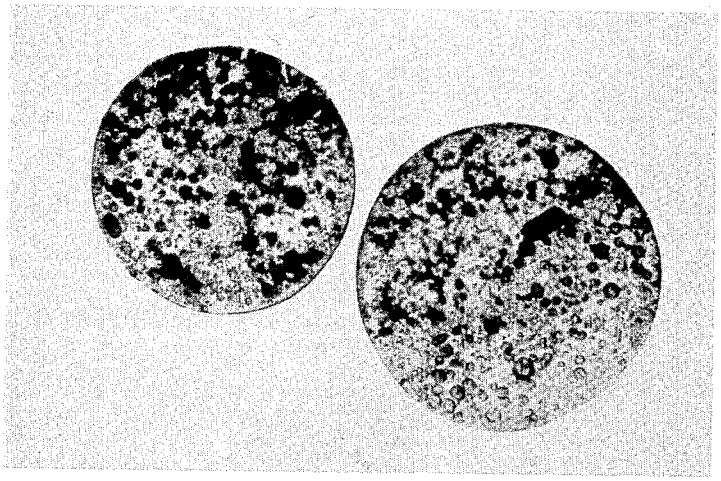

The mixed structure as shown in FIGS. 26 and 27 are the nebular configurations according to the present invention. Dark portions in FIGS. 25 to 27 are polyamide. In the filaments shown in FIGS. 26 and 27, most of stars had a continuous structure in the longitudinal direction of the filament, and a part of stars, particularly, minute stars were in the form of needle or granule extending along the longitudinal direction of the filament.

In the filament $F_1$, polyamides and polyester were separated into each component during the drawing to cause fibrillation, and the resulting fibrils wound round yarn guides, rollers and the like of the drawing machine. On the other hand, in the filament $F_2$ the separation scarcely occurred. It can be seen from the photomicrograph of FIG. 25 showing the cross-section of the filament $F_1$ that polyamide and PET are clearly separated into each component.

In the filament $F_2$, polyamide and polyester having different refractive indexes are finely mixed to form a nebular multi-layer configuration and consequently the light is irregularly reflected and the opacity is high and it has been found that the filament $F_2$ shows a similar delustering effect to that of polyamide filament containing 0.25% of titanium oxide and further has a sufficient delustering effect without containing delustrant, such as titanium oxide and the like. On the contrary, it has been found that the filament $F_1$ has no such delustering effect.

EXAMPLE 2

The same nylon-6 and PET as used in Example 1 were mixed and melted at 280°C in equal amount, stirred thoroughly for 30 minutes, extruded through nozzles, cooled and then cut to obtain mixed pellets (hereinafter abridged as pellet NE). The pellets NE were melted and kneaded by means of an extruder and extruded through orifices on the spinneret plate at 280°C, and then the spun filaments were cooled and wound up on a bobbin at 700 m/min. while oiling. The undrawn filaments thus formed were drawn 3.7 times their original length on a draw pin at 90°C and further heat-set at 140°C under a tension to obtain drawn filaments $F_3$ of 70 d/18 *f*.

Tensile strength, elongation, initial modulus and recovery for fatigue of the filament $F_3$ and the filament $F_2$ obtained in Example 1 are shown in Table 1.

Table 1

| | Tensile strength (g/d) | Elongation (%) | Initial modulus (g/d) | Recovery for fatigue (%) |
|---|---|---|---|---|
| Filament $F_2$ | 4.4 | 22.3 | 58.8 | 76.2 |
| Filament $F_3$ | 3.5 | 20.6 | 56.4 | 70.3 |

As seen from Table 1, the filament $F_2$ is superior in the tensile strength and recovery for fatigue to the filament $F_3$. This is based on the fact that in the filament $F_2$ each component has substantially continuous structure, while in the filament $F_3$, each component has a discontinuous structure of needle-like mixture.

The filament $F_2$ and filaments consisting only of nylon-6 or PET as a control were washed to remove oiling agent, and thereafter the frictional charges of these filaments were measured. The charged voltage of the filament $F_2$ was +200 to +300 volts, while the nylon-6 filament was +1,200 to +1,500 volts and the PET filament was −1,100 to −1,700 volts. It has been found that the apparent frictional charge of the filament $F_2$ is small.

EXAMPLE 3

The same nylon-6 as used in Example 1 and polyethylene oxybenzoate (hereinafter abridged as PEOB) were mix spun by means of two spinnerets as shown in FIG. 16, one of which effected the joining and dividing step 5 times and another of which effected the joining and dividing step 10 times. In either case, the spinneret temperature was 275°C.

The melted nylon-6 was fed to the reservoir 1 and the melted PEOB was fed to the reservoir 2 by gear pumps in equal amount respectively, and both the spinning materials were layer-multiplied by the joining and dividing step and then extruded through orifices 105 into air and the thus spun filaments were cooled and wound up on a bobbin at 700 m/min. after oiling.

The undrawn filaments thus formed were drawn 3.9 times their original length on a draw pin at 90°C to obtain draw filaments of 70 d/18 *f*. The thus obtained filaments in the numbers of joining and dividing step of 5 and 10 are referred to as filaments $F_4$ and $F_5$ respectively hereinafter.

A cross-section of the filament $F_4$ was an archipelagic configuration, while a cross-section of the filament $F_5$ was a nebular configuration. In the filament $F_4$, the separation and yarn breakage occurred frequently during the drawing, while in the filament $F_5$, the separation did not occur at all and the drawability was excellent. The filaments $F_4$ and $F_5$ had a good dyeability.

EXAMPLE 4

The same nylon-6 and PET as used in Example 1 were mix spun by means of two kinds of the spinneret as shown in FIG. 23, one of which had three distributing plates, that is, the number of joining and dividing step was 4, and another of which had nine distributing plates, that is, the number of joining and dividing step was 10. In either case, the spinneret temperature was 280°C.

Nylon-6 was fed by a gear pump to the reservoir 1 in a feed rate of 25 parts by weight and PET was fed by a gear pump to the reservoir 2 in a feed rate of 25 parts by weight. On the other hand, PET was fed to the passage 300 in a feed rate of 50 parts by weight, and then this flow and the layer-multiplied flow of said nylon-6 and PET were joined in a side-by-side relation at a center of a channel 103, and then extruded through orifices 105 into air and the thus spun filaments were cooled and wound up on a bobbin while oiling in a conventional manner. The undrawn filaments thus formed were drawn 3.8 times their original length at 100°C to obtain drawn filaments of 70 d/32 *f*. The thus obtained filaments in the numbers of joining and dividing step of 4 and 10 are referred to as filaments $F_6$ and $F_7$ respectively hereinafter. In the filament $F_6$, the separation frequently occurred during the drawing, while in the filament $F_7$ the separation did not occur at all.

Then, the mixed pellet NE used in Example 2 and PET were melted separately and spun in a side-by-side relation in a conjugate ratio of 1/1 according to a conventional conjugate spinning method, and thereafter treated in the same manner described in describedin the production of the drawn filaments $F_6$ and $F_7$ to obtain drawn filaments of 70 d/32 *f* (hereinafter referred to as filaments $F_8$).

The thus obtained drawn filaments $F_6$, $F_7$ and $F_8$ had a latent crimpability. Further, the filaments $F_6$, $F_7$ and $F_8$ were dipped into boiling water under no load for 10 minutes to develop crimps and dried in air, and thereafter "crimp elongating percentage" and "crimp recovering percentage" as illustrated hereinafter were measured. The obtained results are shown in Table 2.

Table 2

| | Crimp elongating percentage (%) | Crimp recovering percentage (%) |
|---|---|---|
| Filament $F_6$ | 67 | 24.7 |
| Filament $F_7$ | 112 | 40.5 |
| Filament $F_8$ | 109 | 36.3 |

The "crimp elongating percentage" and the "crimp recovering percentage" were determined as follows respectively.

A sample is applied to a first load of 0.5 mg/d and then one minute after such a load is applied, the length of the sample is read, which is the original length $l_0$, and further the sample is applied to a load of 1 g/d and one hour after such a load is applied, the length of said sample is read, which is $l_1$. Then the load is changed to the first load of 0.5 mg/d and one minute after such a load change is effected, the length is read as $l_2$. The crimp elongating percentage and the crimp recovering percentage were calculated according to the following equations.

$$\text{Crimp elongating percentage} = \frac{l_1 - l_0}{l_0} \times 100\ (\%)$$

$$\text{Crimp recovering percentage} = \frac{l_1 - l_2}{l_1 - l_0} \times 100\ (\%)$$

As seen from Table 2, the filament $F_7$ was more excellent in the crimp elongating percentage and the crimp recovering percentage than the filaments $F_6$ and $F_8$.

EXAMPLE 5

Figure 28:
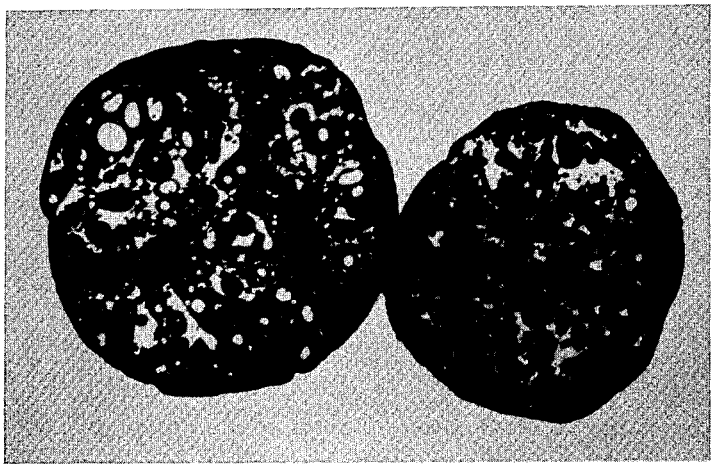

Nylon-6 used in Example 1 and a copolymer of 90 mole % of PET and 10 mole % of PEOB (an intrinsic viscosity in o-chlorophenol at 30°C : 0.58) were fed to the spinneret as shown in FIG. 19, in which the number of distributing plate was 12, that is, the number of joining and dividing step was 13, by gear pumps in equal amount respectively, and then mix spun to obtain undrawn filament $F_9$. A photomicrograph of a cross-section of the filament $F_9$ is shown in FIG. 28. In FIG. 28, dark portion is nylon-6. Even if said nylon-6 is replaced with nylon-66, filaments having a cross-section of the same nebular configuration as in nylon-6 can be obtained. Both of these filaments were favorably delustered and were not fibrillated.

EXAMPLE 6

Nylon-6 having an intrinsic viscosity of 1.2 in m-cresol at 30°C and polyethylene glycol having a molecular weight of 100,000 were mix spun by means of two spinnerets as shown in FIG. 19, one of which had three distributing plates, that is, the number of joining and dividing step was 4, and another of which had fifteen distributing plates, that is, the number of joining and dividing step was 16, while the temperature of the spinneret being maintained at 270°C.

The melted nylon-6 and the melted polyethylene glycol were fed to the reservoirs 1 and 2 respectively by using gear pumps so that the weight ratio is 80/20, and both the spinning materials were mixed in each spinneret and extruded through orifices 105 having a diameter of 0.25 mm$\phi$ into air, and the thus spun filaments were cooled and wound up on a bobbin at a rate of 600 m/min. while oiling, and then the resulting undrawn filaments were drawn 3.9 times their original length at room temperature to obtain drawn filaments of 70 d/18 *f*.

The thus obtained filaments in the numbers of joining and dividing step of 16 and 4 are referred to as filaments $F_{10}$ and $F_{11}$ respectively hereinafter.

Figure 29:
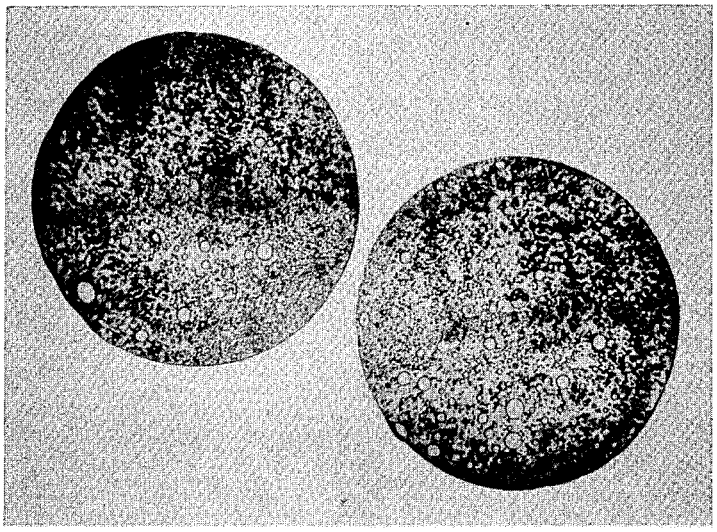

A cross-section of a filament having a particularly large fineness, which was obtained by winding up at a particularly low take-up velocity in the spinning of the filament $F_{14}$, had a nebular configuration as shown in a photomicrograph of FIG. 29. In the filament shown in FIG. 29, most of stars had a continuous structure in a longitudinal direction of the filament, and a part of stars, particularly, minute stars were in the form of needle or granule extending along the longitudinal direction of the filament.

In FIG. 29, the number of stars in the cross-section was approximately 2,000, and presumably the number of stars in the cross-section of the filament $F_{10}$ is the same order as described above. Furthermore, a maximum diameter of the star in the nebulae is about 7/100 of the diameter of the cross-section of the filament. In FIG. 29, a major part of stars are polyethylene glycol and a part of them is polyamide. A cross-section of the filament $F_{11}$ was an archipelagic configuration and the number of islands was 19.

On the other hand, said nylon-6 and said polyethylene glycol were mixed thoroughly in a weight ratio of 80/20, melted by means of a screw extruder, extruded through orifices in the spinneret at 270°C into air and thereafter treated in the same manner as described in production of the filament $F_{10}$ to obtain drawn filaments $F_{12}$.

For the comparison, said nylon-6 was melted, spun and drawn in the same manner as described above to obtain drawn filaments $F_{13}$.

The filaments $F_{11}$ were separated into nylon-6 fibrils and polyethylene glycol fibrils during the drawing, which wound themselves round yarn guides, rollers and the like of the drawing machine, while the drawings of the other filaments $F_{11}$, $F_{12}$ and $F_{13}$ were effected favorably.

The filaments $F_{10}$, $F_{11}$ and $F_{12}$ were extremely smooth in touch as compared with the filament $F_{13}$. In regard to gloss, said four filaments were different but the filaments $F_{10}$ and $F_{12}$ showed a silk-like gloss. The reason will be based on the fact that nylon and polyethylene glycol having different refractive indexes were mixed finely.

EXAMPLE 7

Frictional charge and dynamic properties were measured with respect to the filaments $F_{10}$, $F_{11}$, $F_{12}$ and $F_{13}$ but in the measurement of the frictional charge, the filaments not subjected to oiling in the spinning were used.

The obtained results are shown in Table 3.

Table 3

| | Charged voltage (v) | Tensile strength (g/d) | Elongation (%) | Recovery for fatigue (%) |
|---|---|---|---|---|
| Filament $F_{10}$ | 50 | 4.6 | 25.1 | 86.5 |
| Filament $F_{11}$ | 200 | 4.0 | 24.8 | 74.0 |
| Filament $F_{12}$ | 300 | 3.5 | 26.2 | 73.5 |
| Filament $F_{13}$ | 1,900 | 5.7 | 24.0 | 92.1 |

It can be seen from Table 3 that the filament $F_{10}$ according to the present invention is extremely more excellent in antistatic property and less in the decrease of dynamic properties than the filaments $F_{11}$, $F_{12}$ and $F_{13}$. This is based on the fact that each spinning material in the filament $F_{10}$ is substantially a continuous structure and further a finely mixed structure.

Then, the above described filaments $F_{10}$, $F_{11}$, $F_{12}$ and $F_{13}$ were used and tricots were manufactured therefrom respectively. In warping, the filament $F_{13}$ caused fibrillation and the warping was fairly difficult, but the other filaments were able to be warped smoothly. The tricots manufactured from the filaments $F_{10}$ and $F_{12}$ had a silk-like gloss. Then, the above described tricots were washed with hot water and dried, and thereafter rubbed together with cotton cloth. The voltage generated in the rubbing was measured to obtain a result as shown in Table 4.

Table 4

| Tricot | | Charged voltage (v) |
|---|---|---|
| Tricot composed of | Filament $F_{10}$ | 400 |
| " | Filament $F_{11}$ | 3,500 |
| " | Filament $F_{12}$ | 3,000 |
| " | Filament $F_{13}$ | 9,000 |

It has been found from Table 4 that the tricot manufactured from the filament $F_{10}$ of the present invention is excellent in the antistatic property. The reason why the antistatic property of the tricot composed of the filament $F_{11}$ is inferior to that of the above described filament $F_{11}$ is based on the fact tha polyethylene glycol falls off in the working step.

EXAMPLE 8

Fifteen parts of polyethylene oxide having a molecular weight of 60,000, in which both terminal groups were substituted with nonylphenyl groups, and 85 parts of nylon-6 having an intrinsic viscosity of 1.2 in m-cresol at 30°C were spun with the use of the spinneret as shown in FIG. 19, which had 12 distributing plates, that is, the number of joining and dividing step being 13, and drawn in the same manner as described in Example 6 to obtain drawn filaments $F_{14}$ of 40 *d*/10 *f*. A cross-section of the filament $F_{14}$ was a nebular configuration and the number of stars was about 600.

Then, 15 parts of said polyethylene glycol was added to 85 parts of ε-caprolactam and the resulting mixture was polymerized to obtain a polymer having an intrinsic viscosity of 1.2.

This polymer was cut into pellets, and the resulting pellets were washed with water and dried, and thereafter spun and drawn in the same manner as described in Example 6 to obtain drawn filaments $F_{15}$ of 40 *d*/10 *f*. The filament $F_{15}$ showed a mixed structure of fine granules as a result of microscopy. After the filaments $F_{14}$ and $F_{15}$ were washed with hot water and dried, the frictional charges of these filaments were measured and as the result, the charged voltage of the filament $F_{14}$ was as extremely low as 70 volts, while the charged voltage of the filament $F_{15}$ was 370 volts.

EXAMPLE 9

Eighty parts of the same nylon-6 as used in Example 6 and 20 parts of a mixture of polyethylene oxide having a molecular weight of 10,000, in which both terminal groups were esterified with phosphoric acid, and polyethylene glycol having a molecular weight of 200,000 in a weight ratio of 50/50 were spun with the spinneret as shown in FIG. 19, which had nine distributing plates, that is, the number of joining and dividing step being 10, and drawn in the same manner as described in Example 6 to obtain drawn filaments $F_{16}$ of 70 *d*/28 *f*.

The frictional charge of the filiment $F_{16}$ not subjected to oiling in the spinning was measured and the charged voltage was as extremly low as 40 volts.

The excellent antistatic property of the filiament $F_{16}$ is presumably based on esterification of the terminal of polyethylene oxide with phosphoric acid.

EXAMPLE 10

Eighty parts of nylon-66 having an intrinsic viscosity of 1.16 in m-cresol at 30°C and 20 parts of polypropylene glycol were spun with the spinneret as shown in FIG. 19, which had seventeen distributing plates, that is, the number of joining and dividing step being 18, while maintaining the spinneret temperature at 290°C, and drawn in the same manner as described in Example 6 to obtain drawn filaments $F_{17}$ of 110 *d*/28 *f*.

The filament $F_{17}$ had a silk-like gloss. The filament $F_{17}$ was washed with hot water and dried, and thereafter the frictional charge was measured, and as the result, the charged voltage was 180 volts, which was considerably lower than that of the filament $F_{13}$.

EXAMPLE 11

The same nylon-6 as used in Example 6 and a copolymer having a molecular weight of 100,000, which was obtained by copolymerizing ethylene glycol and propylene glycol in a weight ratio of 50/50, were mix spun by means of the spinneret as shown in FIG. 23, which had 15 distributing plates, that is, the number of joining and dividing step being 16. The spinneret temperature was 270°C.

Twelve parts of the copolymer of ethylene glycol and propylene glycol and 38 parts of nylon-6 were fed to the reservoirs 1 and 2 by gear pumps respectively, and then layer-multiplied. On the other hand, 50 parts of a copolymer, which consisted of 90 parts of ε-caprolactam and 10 parts of hexamethylene diammonium isophthalate and had an intrinsic viscosity of 1.11 in m-cresol at 30°C, was fed to the passage 300, and this flow and said layer-multiplied flow were joined in a side-by-side relation at a center of the channel 103, and then extruded through orifices into air and the thus spun filaments were cooled and wound up on a bobbin while oiling in a conventional manner. The undrawn filaments thus formed were drawn 3.9 times their original length at room temperature to obtain drawn filaments $F_{18}$ of 70 *d*/18 *f*. When the filament $F_{18}$ was dipped in boiling water, crimps developed. The frictional charge of this filament was measured, and as the result, the charged voltage was 204 volts.

EXAMPLE 12

Seventy parts of the same nylon-6 as used in Example 6 and 30 parts of a mixture of polyethylene glycol having a molecular weight of 6,000 and polyethylene glycol having a molecular weight of 150,000 (mixing ratio: 50/50) were spun with the spinneret as shown in FIG. 19, which had fifteen distributing plates, that is, the number of joining and dividing step being 16, and drawn in the same manner as described in Example 6 to obtain drawn filaments $F_{19}$ of 70 *d*/18 *f*. After the filament $F_{19}$ was dipped into boiling water for 30 minutes, a great number of pores were observed by means of a microscope. Furthermore, this filament had a unique touch and a delustered gloss. The tensile strength of this filament was 4.1 g/d and the tensile strength did not decrease considerably, because nylon-6 had a continuous structure in the longitudinal direction of the filament. The porous filaments produced in the other method are unable to maintain such tensile strength.

EXAMPLE 13

By using the above described filaments $F_{10}$, $F_{12}$, $F_{13}$, $F_{14}$, $F_{15}$, $F_{16}$, $F_{17}$, $F_{18}$ and $F_{19}$, respectively, underwears were manufactured and the wearing test was effected with respect to these underwears. All underwears manufactured from the filaments $F_{10}$, $F_{14}$, $F_{16}$, $F_{17}$, $F_{18}$ and $F_{19}$ had an excellent gloss, and did not give unpleasant feeling upon putting on and taking off, and were comfortable. The underwear manufactured from the filament $F_{13}$ was particularly uncomfortable upon putting on and taking off owing to frictional electricity. The underwears manufactured from the filaments $F_{12}$ and $F_{15}$ were fairly comfortable as compared with the underwear manufactured from the filament $F_{13}$, but were fairly uncomfortable as compared with the underwears manufactured from the filaments $F_{10}$, $F_{14}$, $F_{16}$, $F_{17}$, $F_{18}$ and $F_{19}$.

EXAMPLE 14

Fifty parts of the same nylon-66 as used in Example 10 and 50 parts of a mixture of 40 parts of polyethylene glycol having a molecular weight of 10,000 and 60 parts of polyethylene glycol having a molecular weight of 300,000 (mixing ratio: 40/60) were spun with the spinneret as shown in FIG. 19, which had fifteen distributing plates, that is, the number of joining and dividing step being 16, while maintaining the spinneret temperature at 290°C and drawn in the same manner as described in Example 6 to obtain drawn filaments $F_{20}$ of 70 *d*/18 *f*. Further, even if polyalkylene oxide and polyamide were mix spun (mix spinning in fine granule configuration) in a weight ratio of 50/50 in a conventional manner, the spinnability and tensile strength were low, and it is almost impossible to make a product.

The filament $F_{20}$ was used to manufacture a tricot, which was dipped in boiling water for 30 minutes to extract a part of polyethylene glycol. This tricot had a natural fiber-like warm texture, an excellent touch, a particular delustered gloss and an excellent bulkiness. Then, a condition wherein water diffuses into said tricot and a tricot manufactured from the filament $F_{13}$ (both were washed with hot water), was measured to obtain the results as shown in Table 5.

The water diffusing condition is expressed by a time, by which 0.2 c.c. of water drop is completely absorbed into the sample, when such a water drop is fallen on the sample, and when the time necessary for the diffusion is more than 240 seconds, such a sample is considered to be infinity.

Table 5

| Tricot | | Diffusion time (second) |
|---|---|---|
| Tricot composed of | filament $F_{20}$ | 34.5 |
| " | filament $F_{13}$ | infinity |

It can be seen from Table 5 that the tricot manufactutred from the filament $F_{20}$ is extremely excellent in hydrophilicity. Furthermore, the filament $F_{20}$ is particularly suitable for the manufacture of webs for synthetic leather by cutting it into staple fibers. In this case, the extraction of polyethylene glycol may be carried out before the manufacture of webs, but can be effected during or after the manufacture of webs. The fibers obtained by extracting polyalkylene oxide from the filament or staple fibers containing a large amount of polyalkylene oxide or fibrous structure thereof have a finely divided fibril structure, and are very flexible, and give delicate structure.

EXAMPLE 15

PET having an intrinsic viscosity of 0.65 in o-chlorophenol at 30°C and polyethylene glycol (hereinafter abridged as PEG) having a molecular weight of 100,000 were mix spun by means of the spinneret as shown in FIG. 19, which had nine distributing plates, that is, the number of joining and dividing step being 10. The spinneret temperature was maintained at 285°C.

Figure 30:
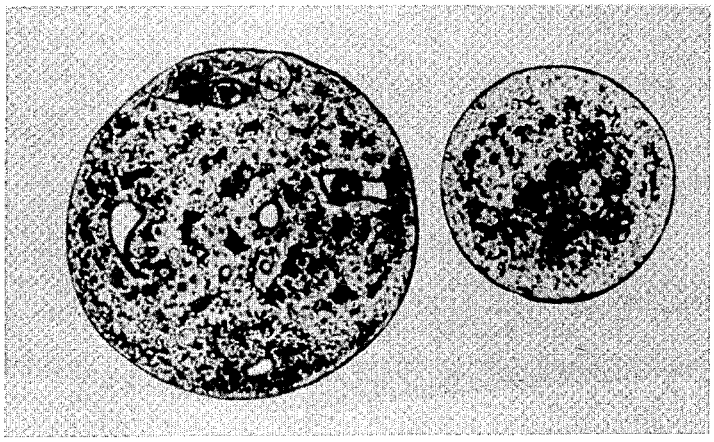

Eighty five parts of the melted PET and 15 parts of the melted PEG were fed to the reservoirs 1 and 2 by gear pumps, respectively, and then both the spinning materials were joined and divided by means of the distributing plates repeatedly, and thereafter extruded through orifices 105 having a diameter of 0.25 mm$\phi$ into air, and the thus spun filaments were cooled and wound up on a bobbin at a rate of 600 m/min. while oiling. The undrawn filaments thus formed were drawn 3.9 times their original length on a draw pin at 100°C to obtain drawn filaments of 70 *d*/28 *f*, which are referred to as filaments $F_{21}$ hereinafter. A filament having a particularly large fineness, which was obtained by winding up at a particular low take-up velocity in the spinning of the filament $F_{21}$, has a nebular configuration, and a cross-section thereof is shown in a photomicrograph of FIG. 30. The number of stars in the cross-section of FIG. 30 was about 700, and the number of stars in the cross-section of the filament $F_{21}$ is presumably near 700. In the filament $F_{21}$ as shown in FIG. 30, a major part of the stars had a continuous structure in the longitudinal direction of the filament, and a part of stars, particularly, minute stars were in the form of needle or granule extending along the longitudinal direction of the filament.

On the other hand, 85 parts of PET and 15 parts of PEG were mixed thoroughly, melted by means of a screw extruder, and extruded through orifices (0.25 mm$\phi$) of the spinneret at 285°C into air, and thereafter the thus spun filaments were cooled, wound up on a bobbin and then drawn 3.9 times their original length on a draw pin at 100°C to obtain drawn filaments of 70 *d*/28 *f* in the same manner as described above, which are referred to as filaments $F_{22}$ herinafter. Furthermore, PET was spun in a conventional melt spinning method and heatdrawn to obtain drawn filaments of 70 *d*/28 *f*, which are called as filaments $F_{23}$ hereinafter.

Additionally, the filaments for testing were prepared without oiling in the spinning, and charged voltage of these filaments was measured.

The frictional charge and dynamic properties of the above-mentioned filaments are shown in Table 6.

Table 6

| | Charged voltage (v) | Tensile strength (g/d) | Elongation (%) | Recovery for fatigue (%) |
|---|---|---|---|---|
| Filament $F_{21}$ | 80 | 4.5 | 22.4 | 76.2 |
| Filament $F_{22}$ | 250 | 3.9 | 22.3 | 70.6 |
| Filament $F_{23}$ | 1,500 | 5.0 | 20.5 | 81.5 |

The filaments $F_{21}$ and $F_{22}$ are considerably superior in the antistatic property to the filament $F_{23}$. The filament $F_{21}$ is superior in the antistatic property, tensile strength and recovery for fatigue to the filament $F_{22}$, because each component in the filament $F_{21}$ has substantially a continuous structure. In the filament $F_{22}$, each component had a needle-like discontinuous structure.

Then, the filaments $F_{21}$, $F_{22}$ and $F_{23}$ were used to produce a taffeta respectively. In the weaving, the filament $F_{23}$ caused fibrillation and the weaving was fairly difficult. the filaments $F_{21}$ and $F_{22}$ had a good weaving ability. The frictional charge generated by rubbing the thus obtained taffeta with cotton cloth, was measured to obtain the results as shown in Table 7.

Table 7

| Taffeta | | Charged voltage (v) |
|---|---|---|
| Taffeta composed of | filament $F_{21}$ | 700 |
| " | filament $F_{22}$ | 1,300 |
| " | filament $F_{23}$ | 11,000 |

It can be seen from Table 7 that the taffeta manufactured from the filament $F_{21}$ of the present invention is excellent.

EXAMPLE 16

The same PET as used in Example 15 and polyethylene glycol (hereinafter abridged as PEG P) having a molecular weight of 120,000, in which both the terminal groups were esterified with phosphoric acid, were mix spun by means of two kinds of spinneret as shown in FIG. 19, wherein the number of joining and dividing step being 4 or 12. The spinneret temperature was maintained at 285°C.

PET and PEG P were spun and drawn in a ratio of 80 parts: 20 parts in the same manner as described in Example 15 to obtain drawn filaments of 70 *d*/28 *f*. The thus obtained filaments in the numbers of joining and dividing step of 4 and 12 are referred to as filaments $F_{24}$ and $F_{25}$ respectively hereinafter. HOwever, oiling was effected by a conventional manner in the winding up.

The filament $F_{24}$ was separated into fibrils, during the drawing, which wound themselves round yarn guides, rollers and the like of the drawing machine. In the filament $F_{25}$, the separation during the drawing was considerably few. The filament $F_{25}$ was high in opacity and had a particular gloss.

The amount of PEG P dissolved off in the filaments $F_{24}$ and $F_{25}$, when they were washed with hot water of 90°C for 30 minutes, was measured and from such an amount, the precentage of PEG P remained in the filaments was calculated and further the frictional charge of the filaments $F_{24}$ and $F_{25}$ was determined before or after the washing with hot water respectively to obtain the results as shown in Table 8.

Table 8

| | Percentage of PEG P remained (%) | Charged voltage before washing | Charged voltage after washing |
|---|---|---|---|
| Filament $F_{24}$ | 57 | 60 | 420 |
| Filament $F_{25}$ | 95 | 55 | 130 |

The filament $F_{25}$ had an excellent antistatic property even after the washing with water. The percentage of PEG P remained in the filament $F_{24}$ was fairly lower than that of the filament $F_{25}$.

EXAMPLE 17

Polyethylene oxide (hereinafter abridged as PEG N) containing nonylphenyl groups at both terminal groups and having a molecular weight of 80,000 and the same PET as used in Example 15 were used as spinning materials, and both materials were spun with the spinneret as shown in FIG. 19, which had eleven distributing plates, that is, the number of joining and dividing step being 12. PET and PEG N were layer-multiplied in a mixed ratio of 88 parts:12 parts and spun in the same manner as described in Example 15, and the thus spun filaments were heat-drawn to obtain drawn filaments of 70 *d*/28 *f*, which are called as filaments $F_{26}$ herinafter.

In addition, dimethyl terephthalate was reacted with methanol, and the ester-interchange reaction was completed, and then when the condensation of polyethylene terephthalate was effected under a reduced pressure, the above described PEG N was added thereto to obtain a polymer blend. The amount of PEG N added was 12% of the polymer blend. The thus obtained polymer blend was spun and heat-drawn according to a conventional melt spinning method to obtain drawn filaments of 70 *d*/28 *f*, which are called as filaments $F_{27}$ hereinafter. The frictional charge and dynamic properties of the above filaments are shown in Table 9, provided that the filaments used for measuring antistatic property have not been treated with oiling in the spinning.

Table 9

| | Charged voltage (v) | Tensile strength (g/d) | Elongation (%) | Recovery for fatigue (%) |
|---|---|---|---|---|
| Filament $F_{26}$ | 110 | 4.3 | 21.4 | 78.5 |
| Filament $F_{27}$ | 150 | 3.7 | 20.2 | 71.2 |

The filaments $F_{26}$ and $F_{27}$ had an excellent antistatic property, but the dynamic properties of the filament $F_{27}$ were inferior to those of the filament $F_{26}$.

EXAMPLE 18

Eighty parts of the same PET as used in Example 15 and 20 parts of a copolymer of ethylene oxide and propylene oxide, which had a molecular weight of 50,000 (copolymerization ratio: ethylene oxide 60/propylene oxide 40), were spun with the spinneret as shown in FIG. 19, which had thirteen distributing plates, that is, the number of joining and dividing step being 14, and then drawn in the same manner as described in Example 15 to obtain drawn filaments of 70 *d*/28 *f*, which are referred to as filaments $F_{28}$ hereinafter. The frictional charge of the filament $F_{28}$ not treated with oiling in the spinning of the filament was measured, and the charged voltage was as low as 60 volts.

Furthermore, when the filament $F_{28}$ was used to produce a taffeta, there was not trouble in the weaving step, and charged voltage due to friction of the obtained taffeta was 500 volts and therefore the antistatic property was excellent.

EXAMPLE 19

PEOB having an intrinsic viscosity of 0.62 in o-chlorophenol at 30°C and the same PEG and PET as used in Example 15 were mix spun by means of the spinneret as shown in FIG. 23, in which the number of joining and dividing step was 10. The spinneret temperature was maintained at 285°C.

Twenty parts of PEG and 30 parts of PEOB were fed to the reservoirs 1 and 2 by gear pumps respectively, and on the other hand 50 parts of PET was fed to the passage 300, and then this flow and the mixed flow of the above described PEG/PEOB were joined at the center of the channel 103 and extruded through the orifices 105 into air and thereafter the thus spun filaments were cooled and wound up on a bobbin while oiling in a conventional manner. The undrawn filaments thus formed were drawn 3.8 times their original length on a draw pin at 100°C to obtain drawn filaments of 70 *d*/28 *f*, which are referred to as filaments $F_{29}$ hereinafter. The filament $F_{29}$ had a latent crimpability, and when this filament was dipped into boiling water for 10 minutes and dried in air, the number of crimps was 14 per cm.

The filament $F_{29}$ developed crimps by treating with hot water was used to produce a tricot, by which a lingerie was manufactured. This lingerie was excellent in touch during the wearing and did not give unpleasant feeling upon putting on and taking off, and had a particular gloss.

EXAMPLE 20

A mixed polyethylene glycol (hereinafter abridged as PEGM) consisting of 40 parts of polyethylene glycol having a molecular weight of 10,000 and 60 parts of polyethylene glycol having a molecular weight of 300,000, and the same PET as used in Example 15 were mix spun by means of the spinneret as shown in FIG. 19, in which the number of joining and dividing step was 9. The spinneret temperature was maintained at 285°C. In the same manner as described in Example 15, PET and PEGM were fed in a feed ratio of 50 parts: 50 parts, spun and wound up on a bobbin. The undrawn filaments thus formed were drawn 3.7 times their original length on a draw pin at 90°C to obtain drawn filaments of 70 *d*/28 *f*, which were referred to as filaments $F_{30}$ hereinafter. The filament $F_{30}$ was dipped into water at 80°C to extract PEGM.

The amount of PEGM extracted corresponded to 7.5% of the weight of the original filament $F_{30}$ and the molecular weight thereof was 12,000. It has been found from the molecular weight of the extracted PEGM that a major part of the extract was polyethylene glycol having a molecular weight of 10,000. When the filament $F_{30}$ was observed by a microscope after PEGM was extracted, pores existed in the interior of the filament.

The filament $F_{30}$, after the extraction, was excellen in touch and had a particularly delustered gloss. Sucl porous filament is excellent in heat insulation and bulk iness, and suitable for applications of clothes, web anc synthetic leather.

Even though a mix spinning of polyester and polyal kylene oxide (granular mix spinning) was attempted ir a weight ratio of 50/50 in a conventional method, the spinnability and tensile strength were low, so that it i: substantially impossible to make a product.

Then, the filament $F_{30}$ was used to produce a taffeta After this taffeta and a taffeta manufactured from the filament $F_{23}$ of Example 15 were washed with hot wate and dried, the hydrophilicity of these taffetas was measured in the same manner as described in Example 14 to obtain the results as shown in Table 10.

Table 10

| Taffeta | | Hydrophilicity (second) |
|---|---|---|
| Taffeta composed of | filament $F_{30}$ | 36.5 |
| " | filament $F_{29}$ | infinity |

It can be seen from Table 10 that the taffeta manufactured from the filament $F_{30}$ is extremely excellent in hydrophilicity.

EXAMPLE 21

Nylon-6 having an intrinsic viscosity of 1.2 in m-cresol at 30°C and polypropylene having a number average molecular weight of 90,000 were mix spun by means of two spinnerets as shown in FIG. 19, one of which was provided with three distributing plates, that is, the number of joining and dividing in the layer-multiplying step was 4, and another of which was provided with eight distributing plates, that is, the number of joining and dividing steps was 9. In either case, the spinneret temperature was maintained at 285°C.

The melted nylon-6 was fed into the reservoir 1 and the melted polypropylene was fed into the reservoir 2 by gear pumps in a weight ratio of nylon-6 to polypropylene of 3/1, and both the spinning materials were layer-multiplied in the spinneret and then extruded through orifices 105 having a diameter of 0.25 mm$\phi$ into air and the extruded filaments were cooled and wound up on a bobbin at a rate of 400 m/min. while oiling. The undrawn filaments thus obtained were drawn 3.8 times their original length on a draw pin at 80°C to obtain drawn filaments of 70 *d*/18 *f*. The thus obtained drawn filament, when the number of joining and dividing step was 9, was referred to as the filament $F_{31}$, and the drawn filament, when the number of joining and dividing step was 4, was referred to as the filament $F_{32}$.

Figure 31:
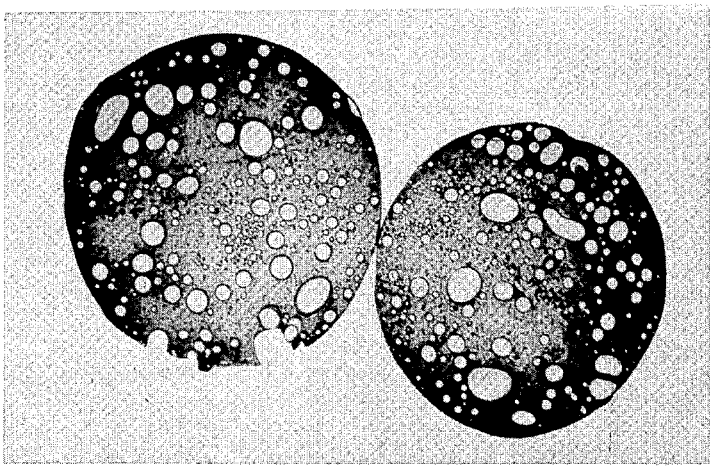

A cross-section of a filament having a particularly large fineness, which was obtained by winding up at a particularly low take-up velocity in the spinning of the filament $F_{31}$ and a nebular configuration. A photomicrograph of the cross-section of the filament $F_{31}$ is shown in FIG. 31. In the filament shown in FIG. 31, most of stars had a continuous structure along the longitudinal direction of the filament, and a part of stars, particularly, minute stars were present in the form of needle or granule extending along the longitudinal direction of the filament. In the filament shown in FIG. 31, the number of stars in the cross-section was about 500, and presumably the number of stars in the crosssection of the filament $F_{31}$ is the same order as described above. The filament $F_{32}$ had an archipelagic configuration at the cross-section, and the number of islands was 18.

While, the above-mentioned nylon-6 pellets and polypropylene pellets were mixed thoroughly in a weight ratio of 3/1 and the resulting mixture was melted in a screw extruder and extruded through the orifices in the spinneret plate at 285°C into air, after which the extruded filaments were treated in the same manner as described in the filament $F_{31}$ to obtain the drawn filament $F_{33}$.

The above-mentioned nylon-6 was melt spun in a conventional method and the spun filaments were treated in the same manner as described in the filament $F_{31}$ to obtain the drawn filament $F_{34}$.

During the drawing of the filament $F_{32}$, filaments were separated into nylon-6 fibrils and polypropylene fibrils, which wound themselves round yarn guides, rollers and the like of the drawing machine, resulting difficulties in the drawing. While, the drawing of the other filaments $F_{31}$, $F_{33}$ and $F_{34}$ were effected without difficulties.

The filament $F_{31}$ was extremely smooth in touch as compared with the filament $F_{34}$. The filament $F_{33}$ had many knobs and inferior touch. The reason will be based on the fact that pellets of nylon-6 and polypropylene having different chemical and physical properties were not mixed homogeneously, and spinning materials having different melt-viscosities were distributed along the longitudinal direction of the filament. As to the gloss, the four filaments were different but the filaments $F_{31}$ and $F_{33}$ showed a delustered gloss. The reason will be based on the fact that nylon-6 and polypropylene having different refractive indexes are mixed finely.

Tensile strength, elongation and recovery for fatigue of the four filaments are shown in Table 11.

Table 11

| Filament | Tensile strength (g/d) | Elongation (%) | Recovery for fatigue (%) |
|---|---|---|---|
| Filament $F_{31}$ | 4.5 | 26.2 | 82.5 |
| Filament $F_{32}$ | 4.1 | 25.1 | 78.3 |
| Filament $F_{33}$ | 3.9 | 26.4 | 73.0 |
| Filament $F_{34}$ | 5.2 | 24.8 | 88.1 |

As seen from Table 11, the filament $F_{31}$ according to the invention is smaller than the other filaments $F_{32}$ and $F_{33}$ in the decrease of dynamic properties, particularly, in the recovery for fatigue. This is based on the fact that each spinning material in the filament $F_{31}$ is substantially a continuous structure and further a finely mixed structure.

EXAMPLE 22

The same nylon-6 as used in Example 21 and polyethylene having a molecular weight of 45,000 were mixed and melt spun by means of a spinneret as shown in FIG. 19, which was provided with 12 distributing plates, that is, the number of joining and dividing in the layer-multiplying step was 13, at a spinneret temperature of 280°C.

The melted nylon-6 was fed into a reservoir 1 and the melted polyethylene was fed into a reservoir 2 by means of gear pumps while metering, and both the spinning materials were layer-multiplied in the spinneret and then extruded through orifices 105 having a diameter of 0.3 mm$\phi$, cooled and wound up on a bobbin at a rate of 400 m/min. without oiling. The undrawn filaments thus obtained were drawn 3.85 times their original length on a draw pin at 80°C to obtain drawn filaments of 110 *d*/28 *f*. When the feed ratios of nylon-6 to polyethylene are 5/1, 3/1, 1/1 and 1/3, the resulting drawn filaments are referred to as filaments $F_{35}$, $F_{36}$, $F_{37}$ and $F_{38}$, respectively.

Frictional charges of four filaments $F_{35}$, $F_{36}$, $F_{37}$ and $F_{38}$ were measured, and the results are shown in Table 12 together with that of the filament $F_{34}$ used in Example 21. Oil adhered to the filament $F_{34}$ was removed with hot water.

Table 12

| Filament | Charged voltage (v) |
|---|---|
| Filament $F_{34}$ | +1,600 |
| Filament $F_{35}$ | +650 |
| Filament $F_{36}$ | +200 |
| Filament $F_{37}$ | −300 |
| Filament $F_{38}$ | −450 |

As seen from Table 12, the filaments $F_{35}$, $F_{36}$, $F_{37}$ and $F_{38}$ according to the invention are more excellent than the filament $F_{34}$ in the antistatic property. The charged voltage varies depending upon the mixing ratio and mixed state of nylon-6 and polyethylene, and further varies depending upon the amount of the functional group for polymerization degree, such as amino group and carboxyl group, contained in the spinning materials. When filaments having an excellent antistatic property are necessary, various filaments having different mixing ratio are produced and a mixing ratio for giving excellent antistatic property is determined.

EXAMPLE 23

Sixty five parts of nylon-66 having an intrinsic viscosity of 1.16 in m-cresol at 30°C and 35 parts of polyethylene having a molecular weight of 18,000 were mix spun with the use of a spinneret kept at 290°C as shown in FIG. 19, which was provided with 14 distributing plates, that is, the number of joining and dividing steps was 15, and drawn in the same manner as described in Example 21 to obtain the drawn filament $F_{39}$ of 70 *d*/28 *f*.

The filaments $F_{39}$ and the filaments $F_{340}$described in Example 21 were knitted into tricots respectively.

The tricot, in which the filament $F_{34}$ was used, had a unique delustered gloss. Then both the tricots were washed with hot water, dried and thereafter rubbed with cotton cloth. The voltage generated in the rubbing was measured to obtain a result as shown in Table 13.

Table 13

| Tricot | Charged voltage (v) |
|---|---|
| Tricot composed of filament $F_{39}$ | 3,000 |
| " filament $F_{34}$ | 8,500 |

EXAMPLE 24

The filaments $F_{31}$, $F_{34}$, $F_{36}$ and $F_{39}$ were knitted into underwears respectively, which were subjected to wearing test. All the underwears, in which filaments $F_{31}$, $F_{34}$ and $F_{39}$ were used respectively, had a splendid gloss, an excellent touch, but had no unpleasant feeling upon putting on and taking off. Therefore, they are comfortable underwears.

On the contrary, the underwear, in which the filament $F_{34}$ was used, had an unpleasant feeling particularly upon putting on and taking off due to the frictional electricity. Moreover, this underwear become dirty faster than the underwears, in which the above-mentioned filaments $F_{31}$, $F_{36}$ and $F_{39}$ were used respectively.

What is claimed is:

1. A multi-component filament formed by mixing and dispersing two different spinning materials having poor affinity and selected from the group consisting of nylon-6, nylon-66, polyethylene terephthalate, polyethylene oxybenzoate, polyolefin and polyalkylene oxide in a unitary filament having a part of its cross-section constituted with a nebular configuration and a part with no nebular configuration, a surface of the filament being occupied with at least two components forming said nebular configuration which contains at least 100 cross-sectional structures having a variety of shapes and sizes, said nebular configuration continuing substantially along the longitudinal direction of the filament, and said cross-sectional structures being dispersed irregularly in the other spinning material, which is obtained by subjecting repeatedly said two spinning materials to a joining step in a narrow channel and a dividing step in a reservoir or to a joining step in a reservoir and a dividing step in a narrow channel in different phase at least eight times to be layer-multiplied.

2. The filament as claimed in claim 1, wherein the part having the nebular configuration and the other part are conjugated in a side-by-side relation.

3. The filament as claimed in claim 1, wherein the part having the nebular configuration and the other part are conjugated in a sheath-core relation.

4. The filament as claimed in claim 1, wherein the part having the nebular configuration and the other part are conjugated eccentrically.

5. The filament as claimed in claim 1, wherein the part having the nebular configuration and the other part are conjugated concentrically.

6. The filament as claimed in claim 1, wherein said number of stars is more than 200.

7. The filament as claimed in claim 1, wherein said polyamide consists essentially of nylon-6 or nylon-66.

8. The filament as claimed in claim 1, wherein said polyalkylene oxide consists essentially of polyethylene oxide.

* * * * *